US008916324B2

(12) United States Patent
Suzuki et al.

(10) Patent No.: US 8,916,324 B2
(45) Date of Patent: Dec. 23, 2014

(54) TONER, METHOD FOR PRODUCING THE SAME, AND DEVELOPER

(75) Inventors: Kazumi Suzuki, Shizuoka (JP); Tatsuya Morita, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 329 days.

(21) Appl. No.: 13/006,076

(22) Filed: Jan. 13, 2011

(65) Prior Publication Data

US 2011/0177447 A1 Jul. 21, 2011

(30) Foreign Application Priority Data

Jan. 20, 2010 (JP) ..... 2010-009731
Mar. 3, 2010 (JP) ..... 2010-046520
May 24, 2010 (JP) ..... 2010-118370

(51) Int. Cl.
*G03G 9/08* (2006.01)
*G03G 9/09* (2006.01)
*G03G 9/087* (2006.01)

(52) U.S. Cl.
CPC ..... *G03G 9/0806* (2013.01); *G03G 9/0821* (2013.01); *G03G 9/08755* (2013.01); *G03G 9/08795* (2013.01); *G03G 9/08797* (2013.01); *G03G 9/0906* (2013.01)
USPC ..... 430/109.5; 430/108.22; 430/109.4

(58) Field of Classification Search
USPC ..... 430/108.22, 109.4, 109.5
See application file for complete search history.

(56) References Cited

U.S. PATENT DOCUMENTS

| | | | | |
|---|---|---|---|---|
| 5,945,245 | A * | 8/1999 | Mychajlowskij et al. | 430/137.14 |
| 6,824,945 | B2 * | 11/2004 | Emoto et al. | 430/137.15 |
| 2004/0076899 | A1 * | 4/2004 | Sugiyama et al. | 430/108.1 |
| 2004/0115551 | A1 | 6/2004 | Sugiyama et al. | |
| 2005/0042534 | A1 | 2/2005 | Tanaka et al. | |
| 2006/0063089 | A1 | 3/2006 | Tanaka et al. | |
| 2008/0032226 | A1 | 2/2008 | Sugiyama et al. | |
| 2008/0318144 | A1 | 12/2008 | Watanabe et al. | |

FOREIGN PATENT DOCUMENTS

| | | |
|---|---|---|
| JP | 2537503 | 7/1996 |
| JP | 3640918 | 1/2005 |
| JP | 2006-18018 | 1/2006 |
| JP | 2006-293304 | 10/2006 |
| JP | 2007-94351 | 4/2007 |
| JP | 2007-94352 | 4/2007 |

(Continued)

OTHER PUBLICATIONS

Machine Translation of JP 2009-030045 A.*

(Continued)

*Primary Examiner* — Jonathan Jelsma
(74) *Attorney, Agent, or Firm* — Oblon, Spivak, McClelland, Maier & Neustadt, L.L.P.

(57) ABSTRACT

The present invention provides a toner containing base particles formed by emulsifying or dispersing, in an aqueous medium, a toner composition liquid which is obtained by dissolving or dispersing, in an organic solvent, at least a binder resin soluble in the organic solvent and a colorant masterbatch containing a colorant and a colorant dispersion resin, wherein the colorant dispersion resin is a resin having sparing solubility defined below: where the "sparing solubility" means that when 4 parts by mass of the colorant dispersion resin are added to and mixed with 10 parts by mass of the organic solvent, the mixture becomes white turbid at 25° C. or becomes a transparent solution once at 25° C. and then becomes white turbid within 12 hours.

17 Claims, 4 Drawing Sheets

YE

(56) References Cited

FOREIGN PATENT DOCUMENTS

| | | | |
|---|---|---|---|
| JP | 2007-248746 | | 9/2007 |
| JP | 2007-248979 | | 9/2007 |
| JP | 4079257 | | 2/2008 |
| JP | 2008-76453 | | 4/2008 |
| JP | 2008-203370 | | 9/2008 |
| JP | 4213067 | | 11/2008 |
| JP | 2009030045 A | * | 2/2009 |
| JP | 2009-57399 | | 3/2009 |
| JP | 2009-116313 | | 5/2009 |
| JP | 2009-139511 | | 6/2009 |
| JP | 2009-169383 | | 7/2009 |
| JP | 4360982 | | 8/2009 |
| JP | 4392207 | | 10/2009 |

OTHER PUBLICATIONS

Extended Search Report issued Jul. 5, 2011 in European Patent Application No. 11151425.3-1217/2348362.

Office Action issued Sep. 13, 2013 in Japanese Application No. 2010-009731.

* cited by examiner

YA

YE

YG

MA

ME

MG

YH

MH

TONER, METHOD FOR PRODUCING THE SAME, AND DEVELOPER

BACKGROUND OF THE INVENTION

1. Field of the Invention

The present invention relates to a toner capable of forming high quality images, for developing latent electrostatic images in electrophotography, electrostatic recording, electrostatic printing and the like. More specifically, the present invention relates to a toner which is excellent in chargeability while maintaining low temperature fixability, and heat resistant storage stability and which is also excellent in permeability (OHP permeability, etc.), a method for producing the same, and a developer using the toner.

2. Description of the Related Art

In electrophotographic apparatuses and electrostatic image recording apparatuses, an electric or magnetic latent image is visualized using a toner. For example, in electrophotography, a latent electrostatic image (latent image) is formed on a photoconductor, an electrostatic image (latent image) is formed on a photoconductor, and then the electrostatic image is developer using a toner to thereby form a toner image. Such a toner image is usually transferred onto a transfer material such as paper, and then fixed on the transfer material by a method such as heating. A toner for use in developing is typically colored particles containing a coolant, a charge controlling agent and other additives in a binder resin. The method of producing a toner is broadly classified into the pulverization method and the suspension polymerization method. In the pulverization method, a colorant, a charge controlling agent, an offset preventing agent and the like are melt-mixed in a thermoplastic resin, and the resulting composition is pulverized and classified to thereby producing a toner. According to the pulverization method, a toner which is excellent in properties to a certain degree can be produced, however, there is a limitation in selection of toner materials. For example, a toner composition obtained by melt-mixing needs to be pulverized and classified by a economically usable device. For this reason, the particle size distribution thereof tends to be wider, and to obtain a copy image having a high resolution and a high gray scale, for example, it is necessary to remove fine power particles having a particle diameter of 5 μm or smaller and coarse powder particles having a particle diameter of 20 μm or greater, and thus the pulverization method has a disadvantage in that the yield becomes very low. In addition, in the pulverization method, it is difficult to uniformly disperse a colorant, a charge controlling agent and the like in a thermoplastic resin. Further, the method has such a problem that a colorant is exposed on a surface of toner, and charges on the surface of the toner become nonuniform, thereby causing degradation in developing properties.

Recently, to overcome these problems in the pulverization method, there have been proposed and implemented toner production methods by a suspension polymerization method. However, such a known polymerization method, for example, a toner obtained by a suspension polymerization method, has a spherical shape and has a drawback in poor cleanability. A toner produced by the suspension polymerization method causes less untransferred toner and is unlikely to cause cleaning failure in a developing/transferring process using an image having low image-occupation-area ratio, however, in the case of a high image-occupation-area ratio, such as a photographic image, or when toner forming an untransferred image due to paper feeding failure or the like remains as untransferred toner and the untransferred toner accumulates, background smear of image occurs. Further, there is a probability that the untransferred toner contaminates a charging roller which contacts and charges the photoconductor, and the charging roller may not exhibit its inherent chargeability. Further, since a toner is polymerized in the production of the toner, in most cases, materials that have been conventionally used for toner cannot be used. Even when such conventional toner materials can be used, the resulting toner is influenced by additives such as a resin and a colorant contained therein, the particle size thereof may not be sufficiently controlled, and thus a toner produced by the suspension polymerization has low freedom degree concerning.

To solve the problems, there has been proposed a method in which resin particles obtained by an emulsification polymerization method are made associated with each other to obtain an indefinite shape toner (Japanese Patent (JP-B) No. 2537503). However, in a toner obtained by an emulsification polymerization method, polyester resins, which exhibit excellent fixability and color suitability in kneading/pulverization method cannot be basically used, and the emulsification polymerization methods have drawbacks of their incapabilities of meeting the requirements of compactness of apparatus, high-speeding performance, and color suitability.

Then, the present applicant proposed a method of obtaining a toner by a dissolution suspension method, using, as a toner material, a polyester-modified resin obtained by reacting a polyester resin precursor which is excellent in transparency, mechanical strength and low temperature fixability (Japanese Patent (JP-B) No. 3640918). With this, such a toner is obtained which can solve the above-mentioned problems, is usable in low temperature fixing system while maintaining high cleanability, excellent in offset resistance and capable of preventing smear on fixing devices and images. However, a toner produced by the dissolution suspension method of JP-B No. 3640918 has a difficulty in dissolving a colorant therein with uniformity and tends to cause localization of colorants (pigments) on toner particle surfaces and a difference of the colorant content in each toner, and thus nonuniformity of charges occurs, leading to degradation in charge stability when used for a long time. In addition, in the case of outputting a color image, slight degradation of developing ability and transferability causes degradation in color balance and gray scale. Further, a colorant in a toner is typically incompatible with resins, and thus it has disadvantages in that when a colorant is poorly dispersed, the toner causes scattering or reflection of transmitted light at its surface boundary, impairing the permeability to OHP and the like.

In the light of the circumstances described above, the present applicant proposed various methods for obtaining a toner by the dissolution suspension method. (see Japanese Patent Application Laid-Open (JP-A) Nos. 2007-94351, 2007-248746, 2007-94352, 2006-293304 2005-70187, 2007-248979, 2008-76453 and 2006-18018).

For example, as a method for obtaining a yellow toner which is excellent in offset resistance, chargeability, storage stability, color formability, tinting strength and heat resistance and has OHP-permeability, the following methods have been proposed: a method of controlling a shape factor using a binder resin and a colorant having a specific structure (Japanese Patent Application Laid-Open (JP-A) No. 2007-94351), and a method of using a specific colorant which is masterbatch processed by kneading with a resin constituting a binder resin (Japanese Patent Application Laid-Open (JP-A) No. 2007-248746). In addition, the present applicant proposed a method of controlling the shape factor of a toner using a colorant having a specific structure, and a dispersant made of an acryl-based polymer having N,N-substituted diamino group and an acidic group (Japanese Patent Application Laid-Open (JP-A) No. 2007-94352). As a method of obtaining a toner in which the dispersibility of a colorant is improved, the present applicant proposed a method of using a dispersant in which the acid value and the amine value are specified (Japanese Patent Application Laid-Open (JP-A) No. 2006-293304). As a method of obtaining a toner capable of maintaining cleanability, responding to low-temperature fixing systems, hand having excellent offset resistance without smearing fixing devices and images, the present applicant proposed a method of granulating toner materials in an aqueous medium containing resin fine particles and inorganic fine particles to thereby make the resin fine particles remain on surfaces of toner particles (Japanese Patent Application Laid-Open (JP-A) No. 2005-70187). Also, as a method of obtaining a toner capable of obtaining high quality images while maintaining the uniformity of the composition, and charging stability but having less fogging and toner scattering, and having small particle diameters and a narrow particle size distribution, the present applicant proposed a method of increasing the volume average particle diameter of a water-in-oil emulsion type dispersion liquid formed in an aqueous medium (Japanese Patent Application Laid-Open (JP-A) No. 2007-248979). Further, as a method of obtaining a toner capable of simultaneously achieving both low temperature fixability and offset resistance and forming high fine images, the present applicant proposed a method of specifying solubility parameters of two or more binder resins (Japanese Patent Application Laid-Open (JP-A) No. 2008-76453). Furthermore, as a method of obtaining a toner ensuring the low temperature fixability, offset resistance and color reproducibility, the present applicant proposed a method of using a colorant which is obtainable by dispersing a pigment in resin components, employing a binder resin containing a crystalline polyester resin and a flashing method (Japanese Patent Application Laid-Open (JP-A) No. 2006-18018).

With the methods described in JP-A Nos. 2007-94351, 2007-248746, 2007-94352, 2006-293304, 2005-70187, 2007-248979, 2008-76453, and 2006-18018, certain effects for solving the above problems are obtained, however, demands for more sophisticated improvement in chargeability and improvement in permeability (OHP etc.) arise, and it is desired to improve the dispersibility of colorants.

Note that as a method of obtaining a yellow toner excellent in chargeability of positive charge, there has been proposed a method of using an acrylic resin, a colorant and an amine compound in the dissolution suspension method (Japanese Patent Application Laid-Open (JP-A) No. 2009-57399). In addition, as a method of obtaining a yellow toner, a method is proposed in which a dispersion containing a resin material, a colorant and an organic solvent is dispersed in an aqueous dispersion medium by a dissolution suspension method, to prepare a dispersion liquid, and the dispersion liquid is uniformly formed (Japanese Patent Application Laid-Open (JP-A) No. 2008-203370).

However, it cannot be said that any of these proposals satisfactorily meet are adequately responsive to the demands for the dispersibility of colorants which are further improved in quality.

In granulation through the above mentioned polymerization method, not only water but also various materials such as a solvent, a surfactant, and a dispersion stabilizer, and thus the required technical level concerning the stability of conventional materials is further raised.

Particularly when toner particles are granulated, the dispersibility of a pigment and a releasing agent in a resin which has been dissolved or dispersed in a solvent greatly influences the fixing temperature range, color reproducibility range and developing properties of the resulting toner, and thus the dispersibility is one of the most important points in a toner production method through granulation of materials in an aqueous medium.

In particular, when Color Index No. PR122 (which may be abbreviated as PR122 hereinbelow) is used for a magenta toner and Color Index No. PY74 (which may be abbreviated as PY74 hereinbelow) is used for a yellow toner, the pigments are localized on the surface of toner because of the intrinsic properties of the pigments, causing a poor dispersed state.

As a result, there is such a problem that the dispersion state of the pigment in toner particles, i.e., the absorption spectrum intensity of the dispersion liquid is lowered as compared with favorably dispersed ones, and the resulting toner becomes inferior in the degree of pigmentation and the chromaticity to those expected.

As a countermeasure against the problem, it has been known that a pigment can be uniformly dispersed in toner using a pigment dispersant and thereby it is possible to produce a toner which is improved in the degree of pigmentation and the chromaticity (see Japanese Patent (JP-B) No. 4079257 and Japanese Patent Application Laid-Open (JP-A) No. 2009-116313).

However, even when the problem is solved and the dispersibility of a colorant is improved depending on a pigment dispersant used, a resin contained in the toner may be considerably lowered in viscosity and in its melting point by adding the pigment dispersant, and the produced toner may be solidified in a container during transportation.

Further, Japanese Patent (JP-B) No. 4213067 discloses a toner in which a crystalline polyester resin is incorporated into a binder resin, and thereby both the heat resistant storage stability and the low temperature fixability are simultaneously achieved.

However, crystalline polyester resins are sparingly soluble in solvents, the pigment cannot be dispersed in a solvent, and thus it is difficult to improve the degree of pigmentation and the chromaticity of the resulting toner.

For this reason, it has been required to disperse such a pigment in a solvent without reducing the viscosity and melting point of a resin used and to design a toner having a high degree of pigmentation, a wide color reproducibility range and excellent in storage stability.

BRIEF SUMMARY OF THE INVENTION

The present invention aims to provide a toner which is excellent in dispersibility of colorants as well as various properties such as chargeability, color properties, low temperature fixability, and heat resistant storage stability, and a method for producing the toner, and a developer.

Means for solving the above-mentioned problems are as follows:

<1> A toner including:

base particles formed by emulsifying or dispersing, in an aqueous medium, a toner composition liquid which is obtained by dissolving or dispersing, in an organic solvent, at least a binder resin soluble in the organic solvent and a colorant masterbatch containing a colorant and a colorant dispersion resin, wherein the colorant dispersion resin is a resin having sparing solubility defined below:

where the "sparing solubility" means that when 4 parts by mass of the colorant dispersion resin are added to and mixed with 10 parts by mass of the organic solvent, the mixture becomes white turbid at 25° C. or becomes a transparent solution once at 25° C. and then becomes white turbid within 12 hours.

<2> The toner according to <1> above, wherein the colorant dispersion resin is a resin containing an amide bond structure and having a weight average molecular weight (Mw) of 5,000 to 50,000.

<3> The toner according to one of <1> and <2> above, wherein the colorant dispersion resin is a polyester resin containing an amide bond structure and having a weight average molecular weight (Mw) of 5,000 to 50,000.

<4> The toner according to any one of <1> to <3> above, wherein the colorant dispersion resin contains a crystalline resin obtained by crystallization of the binder resin.

<5> The toner according to any one of <1> to <4> above, wherein the colorant masterbatch is obtained by melt-kneading an organic pigment-containing colorant and the colorant dispersion resin.

<6> The toner according to any one of <1> to <5> above, wherein the binder resin has compatibility with the colorant dispersion resin when kneaded with the colorant dispersion resin.

<7> The toner according to any one of <1> to <6> above, wherein the colorant contains an organic pigment selected from the group consisting of C.I. Pigment Yellow 74, C.I. Pigment Yellow 185 and C.I. Pigment Red 122.

<8> The toner according to any one of <1> to <7> above, wherein the toner composition liquid contains an active hydrogen group-containing compound and a resin precursor containing a polymer having a functional group reactive with the active hydrogen group of the active hydrogen group-containing compound, and the binder resin is obtained by a reaction of the resin precursor.

<9> The toner according to <8> above, wherein the polymer having the functional group reactive with the active hydrogen group is a polyester having the functional group reactive with the active hydrogen group.

<10> The toner according to any one of <1> to <9> above, wherein the toner composition liquid contains an unmodified polyester (A) together with a polyester (B) having a functional group reactive with an active hydrogen group, and a mass ratio of the polyester (B) to the unmodified polyester (A) is 1/19 to 3/1.

<11> The toner according to any one of <1> to <10> above, wherein the binder resin contains one of a styrene-modified polyester and an olefin-modified polyester.

<12> The toner according to any one of <1> to <11> above, wherein the toner composition liquid further contains a crystalline polyester insoluble in the organic solvent.

<13> The toner according to <12> above, wherein the melting point of the crystalline polyester corresponding to a peak endothermic temperature measured by differential scanning calorimetry (DSC) is 60° C. to 110° C.

<14> A method for producing the toner according to any one of <1> to <13> above, the method including:

dissolving at least the binder resin soluble in the organic solvent and the colorant masterbatch which is obtained by melt-kneading the colorant and the colorant dispersion resin in the organic solvent to prepare a toner composition liquid serving as an oil phase, and emulsifying or dispersing the oil phase in the aqueous medium to prepare an emulsion or a dispersion liquid, and removing the organic solvent from the emulsion or dispersion liquid to form the base particles, where the "sparing solubility" means that when 4 parts by mass of the colorant dispersion resin are added to and mixed with 10 parts by mass of the organic solvent, the mixture becomes white turbid at 25° C. or becomes a transparent solution once at 25° C. and then becomes white turbid within 12 hours.

<15> A developer including:

the toner according to any one of <1> to <13> above, and a carrier.

The present invention can provide a toner which is excellent in dispersibility of colorants as well as various properties such as chargeability, color properties, low temperature fixability, and heat resistant storage stability. With use of the toner, through an image forming method using an electrophotographic process (oil-less fixing system), for example, a copier, a laser printer, and a facsimile, it is possible to continuously and stably form a high quality image having less nonuniformity and decrease of image density and less background smear.

DETAILED DESCRIPTION OF THE INVENTION

Figure 1A:
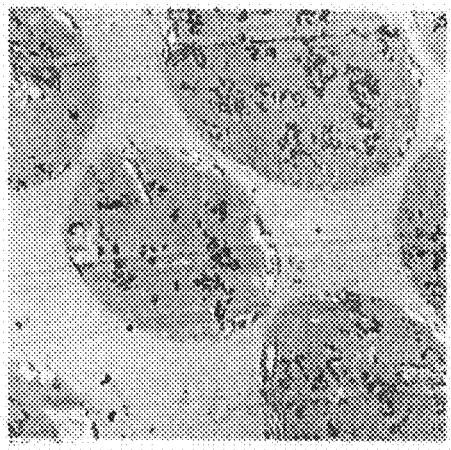
FIG. 1A is a TEM observation image illustrating the pigment-dispersed state of toner base particle (YA) produced in Examples.
Figure 1B:
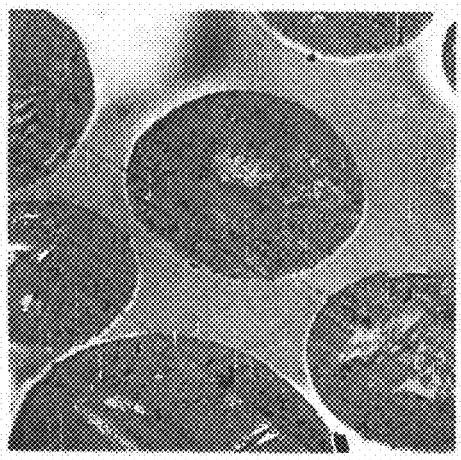
FIG. 1B is a TEM observation image illustrating the pigment-dispersed state of toner base particle (YE) produced in Examples.
Figure 1C:
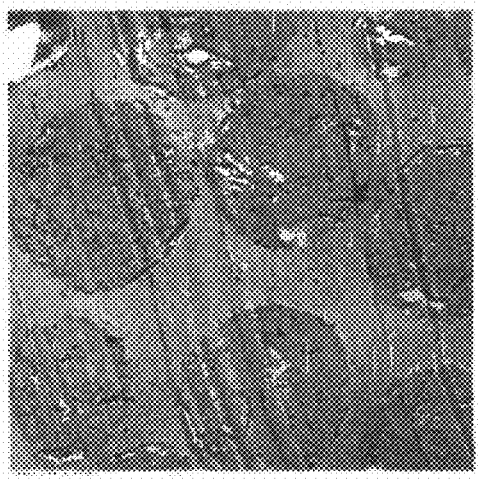
FIG. 1C is a TEM observation image illustrating the pigment-dispersed state of toner base particle (YG) produced in Examples.
Figure 1D:
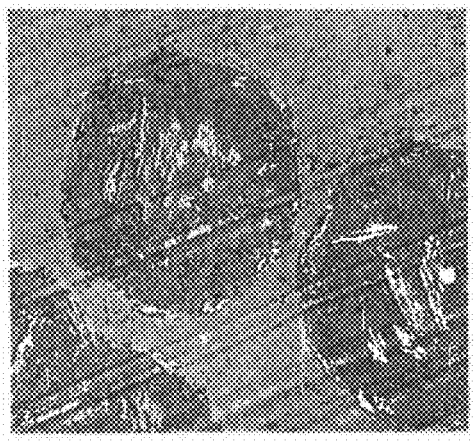
FIG. 1D is a TEM observation image illustrating the pigment-dispersed state of toner base particle (MA) produced in Examples.
Figure 1E:
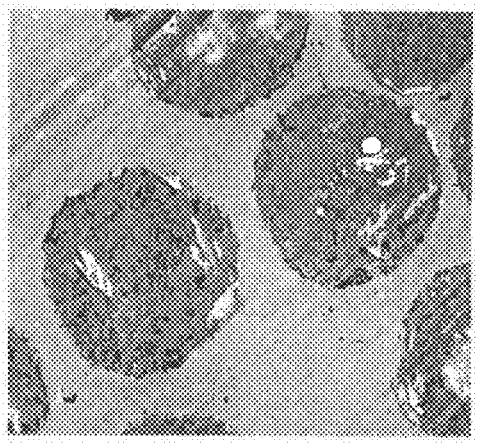
FIG. 1E is a TEM observation image illustrating the pigment-dispersed state of toner base particle (ME) produced in Examples.
Figure 1F:
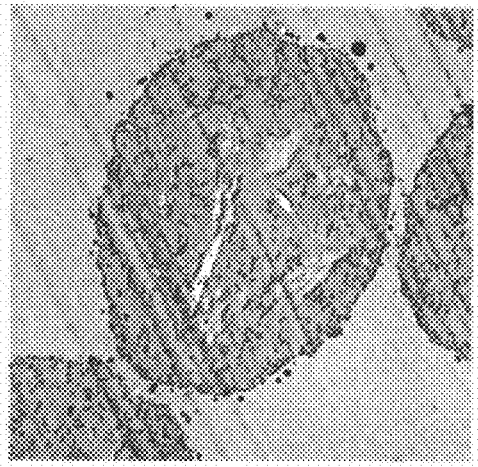
FIG. 1F is a TEM observation image illustrating the pigment-dispersed state of toner base particle (YA), (YE), (YG), (MA), (ME), and (MG) produced in Examples.

A toner according to the present invention is a toner containing base particles formed by emulsifying or dispersing, in an aqueous medium, a toner composition liquid which is obtained by dissolving or dispersing, in an organic solvent, at least a binder resin soluble in the organic solvent and a colorant masterbatch containing a colorant and a colorant dispersion resin, wherein the colorant dispersion resin is a resin having sparing solubility defined below.

The term "sparing solubility" means that when 4 parts by mass of the colorant dispersion resin are added to and mixed with 10 parts by mass of the organic solvent, the mixture becomes white turbid at 25° C. or becomes a transparent solution once at 25° C. and then becomes white turbid within 12 hours.

Note that in the present invention, "a toner containing base particles formed by emulsifying or dispersing, in an aqueous medium, a toner composition liquid which is obtained by dissolving or dispersing a toner composition in an aqueous medium in which resin fine particles are dispersed" is called "a toner containing base particles". Further, the "toner containing base particles" may be called "toner", simply.

As described above, the toner of the present invention contains, as a toner material composition, at least a binder resin containing a polyester soluble in organic solvents as the main component, a colorant masterbatch and a releasing agent. Such a toner material composition is dissolved or dispersed in an organic solvent to prepare a toner composition liquid (oil phase), the oil phase is emulsified or dispersed in an aqueous medium (aqueous phase) in which resin fine particles are dispersed, and the resulting emulsion or dispersion liquid is subjected to desolventation and granulation to form base particles. With inclusion of the base particles, the toner of the present invention can be obtained. The base particles can be obtained by drying the emulsion or dispersion liquid that has been subjected to desolventation and granulation, or the base particles can be obtained by simultaneously subjecting to desolventation and drying.

That is, the present inventors carried out extensive studies and examinations and found that by using, as a toner material composition, a colorant masterbatch which is prepared by preliminarily dissolving and kneading a colorant containing an organic pigment and the polyester having sparing solubility defined as above and having a weight average molecular weight (Mw) of 5,000 to 50,000, it is possible to uniformly disperse the colorant containing an organic pigment in base particles without localizing the colorant on surfaces of the base particles, with this, it is possible for the toner containing the base particles to exhibit uniform chargeability and maintain the charge stability even in use for a long time, to form an image excellent in color properties and further to produce an effect of suppress diffuse reflection of light transmitted at the interface of the toner and thereby to improve the permeability to OHP or the like.

Also, in the present invention, by the effect of the binder resin containing at least polyester as the main component, the chargeability and color properties of the toner can be exhibited while maintaining the low temperature fixability, hot offset resistance, and heat resistant storage stability as described below.

The polyester resin which is granulated in an aqueous medium and used as a toner binder needs to be dissolved or dispersed in an organic solvent. In most, polyester resins having crystallinity are not dissolved in an organic solvent for use in granulation of toner particles, such as ethyl acetate, and thus a polyester resin having low crystallinity or an amorphous polyester resin is usually employed.

Also, in a system in which resins are not dissolved, it is difficult to disperse various materials, such as waxes and pigments, in the resin, and thus it is difficult to use a crystalline resin for a toner binder.

In addition, the dispersed state of a pigment in toner particles varies depending on the surface properties of various materials in the granulation process. For example, in a toner granulated in an aqueous medium, it is necessary to disperse non-aqueous materials in which toner materials are dispersed, and thus a surfactant is used. However, depending on the kind of the surfactant, the granulated particles may not be uniformly dispersed, such as aggregates of a pigment in the granulated toner particles may be generated, and the granulated toner particles may be localized on surfaces of the toner particles, although the dispersed state of the pigment in a varnish to which the pigment is added to the solution containing the resin and the organic solvent. When a pigment are be uniformly dispersed in toner particles, it may be a significant factor to cause degradation of the color reproducibility range after image formation.

The present inventors found that it is possible to prevent a pigment from aggregating or being localized on surfaces of toner particles in the process of toner granulation in an aqueous medium, by using a crystalline resin insoluble in organic solvents as a masterbatch.

By subjecting the pigment to a surface treatment with the crystalline resin insoluble in organic solvents, the pigment is not directly contacted with various materials, such as a surfactant, which seem to adversely affect the dispersion of the pigment in the toner granulation. Then, its is possible to prevent or drastically reduce the aggregation and localization of the pigment caused by the surfactant without dissolving the resin adsorbed on the surface of the pigment and without the pigment surface being exposed, to thereby uniformly disperse the pigment in the toner particles and to prevent the decreases in viscosity and in melting point of the binder resin.

Hereinafter, the toner material composition (toner material) for use in the toner containing base particles of the present invention will be described in series.

Note that, the "the polyester having sparing solubility defined as above and having a weight average molecular weight (Mw) of 5,000 to 50,000" may be abbreviated as and called "polyester", simply.

[Colorant Dispersion Resin]

As for the colorant masterbatch, a melt-kneaded product obtained by melt-kneading an organic pigment-containing colorant and a colorant dispersion resin is used. As the colorant dispersion resin, a polyester resin containing an amide bond structure amide bond structure is used. Specifically, the colorant dispersion resin (polyester containing an amide bond structure) of the present invention is a resin containing an amide bond obtained by reacting amine with a carboxyl group in polyester. Examples of the amine, but not limited to, include, as aliphatic amines, primary amines (e.g., methyl amine, ethyl amine, propyl amine, isopropyl amine, butyl amine, isobutyl amine, 2-aminobutane, 2-amino-2-methylpropane, 1-aminopentane, isopentyl amine, 2-amino-2-methylbutane, 1-aminohexane, 1-aminoheptane, 1-aminooctane, 2-ethylhexyl amine, 1-aminononane, 1-aminodecane, and aminoethylene; secondary amines (e.g., dimethylamine, diethylamine, diisopropylamine, N-methylethylamine, and N-methyl isobutyl amine. Examples of the amine, as aromatic amines, include aniline, toluidine ethylanine, cumidine, p-tert-butylaniline, p-tert-pentylaniline, xylidine, thymylamine, pusoid cumidine, 2,4,6-trimethylaniline, pentamethylaniline, aminostyrene, N-dimethylaniline, N,N-diethylaniline, N,N-dimethyltoluidine, diphenylamine, di-p-tolylamine, N-methyldiphenylamine, triphenylamine, N-benzyl-N-methylaniline, N,N-dibenzylaniline, diaminobenzene, toluenediamine, N-methylphenylenediamine, N,N-dimethylphenylenediamine, N,N'-dimethylphenylenediamine, aminodiphenylamine, diaminophenylamine, 4,4'-bis(dimethylamino)diphenylamine, benzenetriamine, 1,2-dianilinoethane, 1,2-dianilinopropane, and stilbenediamine.

Here, as the polyester containing an amide bond structure, the one having a weight average molecular weight (Mw) of 5,000 to 50,000 is suitably used. When the weight average molecular weight (Mw) of the polyester is less than 5,000, the pigment dispersibility degrades due to insufficient functionality of steric hindrance. When the weight average molecular weight (Mw) is more than 50,000, the resulting mixture is increased in viscosity when the polyester is melt-kneaded with a colorant, and the temperature required for obtaining excellent dispersibility exceeds 150° C., and thus oxidation, decomposition of the resin and decomposition of the organic pigment occurs and the respective functions of these components cannot be maintained. In addition, since the amount of energy for melt-kneading is increased, the environmental burden is increased. A more preferred weight average molecular weight (Mw) of the polyester containing an amide bond structure is 10,000 to 30,000.

When the weight average molecular weight (Mw) is less than 5,000, the pigment is localized on the surface of the toner, and the dispersed state (through TEM observation) of the pigment is nonuniform and the particle diameter of the pigment is also increased. In contrast, when the weight average molecular weight (Mw) exceeds 50,000, the particle diameter of the pigment is increased (for example, 300 nm or greater), the uniform dispersibility of the colorant is impaired, and it is difficult to achieve excellent chargeability, color properties and permeability, in both cases.

Note that the polyester containing an amide bond structure is suitably used also from the viewpoints of low temperature fixability, mechanical strength and dynamic viscoelasticity.

As described above, as the colorant masterbatch of the present invention, a melt-kneaded product obtained by preliminarily melt-kneading an organic pigment-containing colorant and a polyester containing an amide bond structure. As the melt-kneaded product, the one that is heated (at about 100° C. to about 150° C.), followed by cold rolling and pulverization is preferably used.

When as the colorant masterbatch, for example, a product which is obtained by dissolving an organic pigment-containing colorant and a polyester containing an amide bond structure in an organic solvent (e.g., ethyl acetate), and grinding with a bead mill is used, the pigment is localized on the toner surface and has large particle diameters, the uniform dispersibility of the colorant cannot be exhibited, and the effect as described in the present invention cannot be obtained.

The glass transition temperature (Tg) of the colorant dispersion resin (polyester containing an amide bond structure) is preferably 50° C. to 100° C., and more preferably 60° C. to 80° C. When the glass transition temperature (Tg) is lower than 50° C., the heat resistant storage stability of the toner degrades. When it is higher than 100° C., the amount of energy for melt-kneading is increased, and the environmental burden is increased, which also affects the low temperature fixability of the toner.

Note that concerning the glass transition temperature (Tg) of the resin, a temperature corresponding to a point of intersection of a direct extension of the baseline temperature of a region of a lower temperature side of DSC curve from a peak endothermic temperature (maximum endothermic temperature) determined by a differential scanning calorimeter (DSC) with a tangent that shows the maximum inclination from a temperature-rise portion of the peak endothermic temperature to the peak top temperature is determined as the glass transition temperature.

The colorant dispersion resin (polyester) is preferably sparingly soluble, at a temperature of 50° C. or lower, in an organic solvent used in preparation of the toner composition liquid and in formation of base particles.

In the present invention, the "colorant dispersion resin (polyester) is sparingly soluble in an organic solvent" is defined as a mixture (of the colorant dispersion resin and the organic solvent) becomes white turbid at 25° C. or becomes a transparent solution once at 25° C. and then becomes white turbid within 12 hours after 4 parts by mass of the colorant dispersion resin are added to and mixed with 10 parts by mass of the organic solvent. In the present invention, a mixture of the colorant dispersion resin and the organic solvent which becomes white turbid immediately after being mixed and stirred is defined as having sparing solubility. Some mixtures thereof are dissolved and become a transparent solution once when being mixed and stirred, but then left standing and stored, the transparent solution becomes white turbid. Such mixtures belonging to those within the range of the definition described above are determined as being sparingly soluble.

When the colorant dispersion resin is soluble in an organic solvent used, the colorant (organic pigment) tends to be exposed on surfaces of base particles, and when the colorant dispersion resin is insoluble in an organic solvent used, the organic pigment tends to form aggregates in the toner.

When the colorant dispersion resin is sparingly soluble in an organic solvent used, the compatibility of the colorant dispersion resin with a binder resin soluble in the organic solvent can be satisfied, and the tendency of the organic pigment of being exposed on surfaces of the base particles is suppressed.

Note that the amide bond structure is preferably present in the polyester containing an amide bond structure. Specifically, the amount of the polyester containing an amide bond structure is preferably 0.01% by mass or more and less than 3.0% by mass, more preferably 0.01% by mass to 1% by mass, relative to the total amount of the toner. When the amount of the amide-bond structure-containing polyester is less than 0.01% by mass, the function thereof is not exhibited, and the pigment dispersibility may degrade. When the amount of the amide-bond structure-containing polyester is 3.0% by mass or more, the chargeability of the toner may be unstable.

In the colorant dispersion resin (polyester containing an amide bond structure) for use in the present invention, as a means of controlling the solubility, it is preferable to use an epoxy compound. That is, a carboxyl group in the polyester is reacted with an epoxy group in the epoxy compound so as to incorporate an ether bond structure and an ester bond structure derived from the epoxy compound into the polyester resin structure, and thereby the solubility of the colorant dispersion resin can be controlled.

The epoxy compound is not particularly limited and may be suitably selected in accordance with the intended use. Examples of the epoxy compounds include mono-epoxy compounds (e.g., monoglycidyl esters of neodecanoic acid); bisphenol A-type epoxy resins, bisphenol F-type epoxy resins, cresol novolac-type epoxy resins, phenol novolac-type epoxy resins; and polyepoxy compounds (e.g., ethylene glycol diglycidyl ether, glycerin triglycidyl ether, trimethylolpropane triglycidyl ether, trimethylolethane triglycidyl ether, pentaerythritol tetraglycidyl ether, and hydroquinone diglycidyl ether. These may be used alone or in combination.

The colorant dispersion resin preferably contains a crystalline resin obtained by crystallization of a binder resin.

The crystalline resin is preferably a crystalline polyester. The crystalline polyester can be obtained by heating a solution, in which a polyester resin is dissolved in an organic solvent so as to have a resin concentration of 10% or lower, and slowly cooling the solution in a quiescent state. The degree of crystallinity of the crystalline polymer can be controlled with the resin concentration. When the resin concentration is low, the crystalline resin is easily oriented, and thus the degree of crystallinity can be increased. The crystalline polyester in the present invention is preferably a linear polyester, and more preferably an aromatic linear polyester.

Here, the degree of crystallinity means a state between a state where a certain polymer is present as crystal phases with 100% probability and a state where a certain polymer is present as amorphous phases with 100% probability. However, since it is difficult to make a variety of crystal phases present, and it is also difficult to reproduce a 100% crystallized state and a 100% amorphous state, an index of the crystallized state should be considered. In general, the higher crystallinity a material has, the higher the density becomes, and the density can be used as an index of crystallinity.

Since the colorant dispersion resin for masterbatch is a crystalline resin, the colorant dispersion resin preferably has a higher density than the resin used for the binder resin.

The colorant dispersion resin preferably has a density of 1.25 g/cm$^3$ or higher and lower than 1.45 g/cm$^3$.

When the density is lower than 1.25 g/cm$^3$, the crystallinity of the colorant dispersion resin is insufficient, the resin used in a surface treatment of the pigment is dissolved in the solvent, the pigments surface is exposed, and an interaction of the surfactant is increased during granulation, thereby causing degradation in the dispersibility of the toner, which may cause degradation in image quality. When the density is higher than 1.45 g/cm$^3$, the toner is melted in excess when fixed in the formation of an image, and unfavorably, an offset image may occur in non-image portions or the melting of toner may not occur depending on the material used, however, it becomes difficult to appropriately maintain the fixability.

By using the thus obtained crystalline polyester insoluble in organic solvents, an effect of improving the fixability in fixing processes can be obtained.

The crystalline polymer for use in the present invention is not particularly limited and may be suitably selected in accordance with the intended use. For example, the crystalline polymer can be obtained from the following materials.

The crystalline polyester preferably contains, as an alcohol component, a diol compound having 2 to 6 carbon atoms (e.g., 1,4-butanediol, 1,6-hexanediol, and derivatives thereof), as an acid component, at least one selected from a maleic acid, a fumaric acid, a succinic acid and derivatives of these acids. As a method of controlling the crystallinity and the softening point of the crystalline polymer, for example, there may be exemplified a method of molecularly designing a nonlinear polyester suitably for use. Such nonlinear polyesters can be synthesized by adding a trihydric or higher polyhydric alcohol (e.g., glycerin) to the alcohol component and adding a trivalent or higher polyvalent carboxylic acid (e.g., trimellitic anhydride) to the acid component in the synthesis of polyester so that the polymer is condensation polymerized.

[Organic Pigment-Containing Colorant]

The organic pigment-containing colorant is not particularly limited and may be suitably selected from among known pigments. Examples of the pigments include, but not limited to, carbon black, Nigrosine dyes, black iron oxide, NAPHTHOL YELLOW S, HANSA YELLOW (10G, 5G and G), Cadmium Yellow, yellow iron oxide, loess, chrome yellow, Titan Yellow, polyazo yellow, Oil Yellow, HANSA YELLOW (GR, A, RN and R), Pigment Yellow L, BENZIDINE YELLOW (G and GR), PERMANENT YELLOW (NCG), VULCAN FAST YELLOW (5G and R), Tartrazine Lake, Quinoline Yellow Lake, ANTHRAZANE YELLOW BGL, isoindolinone yellow, red iron oxide, red lead, orange lead, cadmium red, cadmium mercury red, antimony orange, Permanent Red 4R, Para Red, Fire Red, para-chloro-ortho-nitroaniline red, Lithol Fast Scarlet G, Brilliant Fast Scarlet, Brilliant Carmine BS, PERMANENT RED (F2R, F4R, FRL, FRLL and F4RH), Fast Scarlet VD, VULCAN FAST RUBINE B, Brilliant Scarlet G, LITHOL RUBINE GX, Permanent Red FSR, Brilliant Carmine 6B, Pigment Scarlet 3B, Bordeaux 5B, Toluidine Maroon, PERMANENT BORDEAUX F2K, HELIO BORDEAUX BL, Bordeaux 10B, BON MAROON LIGHT, BON MAROON MEDIUM, Eosin Lake, Rhodamine Lake B, Rhodamine Lake Y, Alizarine Lake, Thioindigo Red B, Thioindigo Maroon, Oil Red, Quinacridone Red, Pyrazolone Red, polyazo red, Chrome Vermilion, Benzidine Orange, perynone orange, Oil Orange, cobalt blue, cerulean blue, Alkali Blue Lake, Peacock Blue Lake, Victoria Blue Lake, metal-free Phthalocyanine Blue, Phthalocyanine Blue, Fast Sky Blue, INDANTHRENE BLUE (RS and BC), Indigo, ultramarine, Prussian blue, Anthraquinone Blue, Fast Violet B, Methyl Violet Lake, cobalt violet, manganese violet, dioxane violet, Anthraquinone Violet, Chrome Green, zinc green, chromium oxide, viridian, emerald green, Pigment Green B, Naphthol Green B, Green Gold, Acid Green Lake, Malachite Green Lake, Phthalocyanine Green, Anthraquinone Green, lithopone, and mixtures thereof. These may be used alone or in combination.

In particular, preferably usable examples of the organic pigment-containing colorant include, but not limited to, Pigment Red colorants (e.g., C.I. Pigment Red 122, C.I. Pigment Red 269, C.I. Pigment Red 238, C.I. Pigment Red 146, and C.I. Pigment Red 185); C.I. Pigment Yellow colorants (e.g., C.I. Pigment Yellow 93, C.I. Pigment Yellow 128, C.I. Pigment Yellow 155, C.I. Pigment Yellow 180, C.I. Pigment Yellow 74, and C.I. Pigment Yellow 185); and C.I. Pigment Blue colorants (e.g., C.I. Pigment Blue 15:3).

Some of the colorants are excellently dispersible in toner without using a dispersant, however, concerning C.I. Pigment Yellow 74, C.I. Pigment Yellow 155, C.I. Pigment Yellow 180, C.I. Pigment Yellow 185, C.I. Pigment Red 122 and the like, the organic pigment tends to move on surfaces of base particles and localized thereon when an emulsion or a dispersion liquid, in which a toner composition (oil phase) has been emulsified or dispersed in an aqueous medium (aqueous phase), is subjected to desolventation. This may significantly impair the chargeability of the resulting toner.

The colorant is used in the form of a colorant masterbatch (hereinbelow, may be abbreviated as "masterbatch") in which the organic pigment and the colorant dispersion resin (polyester containing an amide bond structure) are kneaded under heating.

As a unit for producing the masterbatch, for example, high shearing force type dispersing machines, such as a two-roll mill, a triple roll mill, a kneader, a uniaxial extruder, a biaxial extruder, and an open roll continuous kneader, can be used.

The particle diameter of the colorant in the masterbatch is preferably 300 nm or smaller, for example. When the particle diameter is greater than 300 nm, and when a toner is produced with the colorant, the image quality may easily degrade. In particular, light transmissivity of OHP may easily degrade. The particle diameter of the colorant is preferably 250 nm or smaller, and more preferably 150 nm or smaller (for example, in Examples of the present invention, when the pigment dispersion state was observed by a TEM, a pigment diameter of 150 nm or smaller was graded as A; and a pigment diameter of greater than 150 nm and 250 nm or smaller was graded as B). Note that in the case of a colorant having small diameters, the color resistance of the resulting toner degrades, and thus the particle diameter of the colorant is preferably 30 nm or greater, and more preferably 50 nm or greater.

The particle diameter of the colorant (organic pigment) can be determined by TEM observation of cross-sections of toner particles. In this case, it is important to determine the particle diameter of the organic pigment from at least 30 or more toner particles.

The colorant masterbatch is dissolved in an organic solvent soluble in the polyester containing an amide bond structure, and the resulting solution is subjected to measurement of particle size by a laser light scattering method, using a laser diffraction/scattering type particle size distribution measurement device ("LA-920", manufactured by HORIBA Ltd.), and thereby the particle diameter of the colorant (organic pigment) can be determined.

The colorant (organic pigment) content in the toner is not particularly limited and may be suitably selected in accordance with the intended use. It is, however, preferable to control the amount of the organic pigment to be 3% by mass to 15% by mass, and more preferable to control it to be 5% by mass to 10% by mass. When the organic pigment content is less than 3% by mass, the tinting strength of the toner degrades. In contrast, when the organic pigment content is more than 15% by mass, dispersion failure of the pigment easily occurs in the toner, and this may cause degradation in electric properties of the toner.

[Binder Resin]

The binder resin contains at least polyester as a main component. By inclusion of polyester as the main component, the properties including low temperature fixability, chargeability, transparency and hardness of the toner can be made suitable.

The polymer in the present invention is a resin having a polyester structure which can be obtained by condensation polymerization of an alcohol component and a carboxylic acid component (acid component), and also virtually includes polyesters which are modified so as not to impair the properties thereof. Note that the condensation polymerization of an alcohol component and a carboxylic acid component can be preferably carried out in the presence of an esterification catalyst.

The alcohol component constituting the polyester (which may be referred to as "polyester-based polymer" hereinbelow) is not particularly limited, and the following monomers are exemplified.

Examples of dihydric alcohol components include ethylene glycol, propylene glycol, 1,3-butanediol, 1,4-butanediol, 2,3-butanediol, diethylene glycol, triethylene glycol, 1,5-pentanediol, 1,6-hexanediol, neopentyl glycol, 2-ethyl-1,3-hexanediol, hydrogenated bisphenol A, and diols obtainable by polymerization of cyclic ether (e.g., an ethylene oxide, and a propylene oxide) with bisphenol A.

Examples of trihydric or higher polyhydric alcohols include glycerin, pentaerythritol, trimethylolpropane, sorbitol, and their alkylene (having 2 to 4 carbon atoms) oxide adducts of alkylene.

The acid component forming the polyester-based polymer is not particularly limited, and the following monomers are exemplified.

Examples of divalent acid components include benzene dicarboxylic acids (e.g., phthalic acid, isophthalic acid, and terephthalic acid) or anhydrides thereof; alkyl dicarboxylic acids (e.g., succinic acid, adipic acid, sebacic acid, and azelaic acid) or anhydrides thereof; unsaturated dibasic acids (e.g., maleic acid, citraconic acid, itaconic acid, alkenylsuccinic acid, fumaric acid, and mesaconic acid); and unsaturated dibasic anhydrides (e.g., maleic anhydride, citraconic anhydride, itaconic anhydride, and alkenylsuccinic anhydride).

Examples of the trihydric or higher polyhydric carboxylic acid component include trimellitic acid, pyromellitic acid, 1,2,4-benzene tricarboxylic acid, 1,2,5-benzene tricarboxylic acid, 2,5,7-naphthalene tricarboxylic acid, 1,2,4-naphthalene tricarboxylic acid, 1,2,4-butane tricarboxylic acid, 1,2,5-hexane tricarboxylic acid, 1,3-dicarboxy-2-methyl-2-methylenecarboxy propane, tetra(methylenecarboxy)methane, 1,2,7,8-octane tetracarboxylic acid, Empol trimer acid, and their anhydrides and partial lower alkyl esters.

A weight average molecular weight (Mw) of a tetrahydrofuran (THF) soluble fraction of the polyester in a molecular weight distribution measured by gel permeation chromatography (GPC) is preferably 7,500 to 30,000, and more preferably 10,000 to 20,000. When the weight average molecular weight (Mw) is less than 7,500, the heat resistant storage stability of the toner may degrade. In contrast, when the weight average molecular weight (Mw) is more than 30,000, the low temperature fixability of the toner may degrade.

The glass transition temperature of the polyester is preferably 40° C. to 70° C., and more preferably 50° C. to 60° C. When the glass transition temperature (Tg) is lower than 40° C., the heat resistant storage stability of the toner may degrade, and when it is higher than 70° C., the low temperature fixability of the toner may become insufficient.

The acid value of the polyester is preferably 1.0 mgKOH/g to 50.0 mgKOH/g, and more preferably 1.0 mgKOH/g to 30.0 mgKOH/g. By imparting an acid value to the toner in this way, the toner is generally easily negatively charged.

A toner having an acid value and a hydroxyl value each higher than the above-mentioned range is susceptible to be affected by the environmental conditions, for example, under high temperature-high humidity conditions, or low temperature-low humidity conditions, and easily causes degradation in image quality.

In the present invention, the acid value of the binder resin is determined according to the following method of from (I) to (IV), and the basic procedure of measurement is in conformance with JIS K-0070.

(I) A binder resin sample is used after additives other than a binder resin (polymer components) are removed therefrom or after the acid values and the amounts of components other than the binder resin or crosslinked binder resin are determined. A pulverized product of the sample is precisely weighed (0.5 g to 2.0 g), and the weight of the polymer component is regarded as W g. For example, when an acid value of a binder resin is measured from a toner, the acid value and the amounts of colorants or magnetic materials are separately measured, and then the acid value of the binder resin is determined by calculation.

(II) The sample is charged to a 300 mL-beaker, and a mixture of toluene/ethanol (volume ratio: 4/1) (150 (mL)) is added thereto and dissolved.

(III) The resulting solution is titrated with a 0.1 mol/L KOH ethanol solution, using a potentiometric titration device.

(IV) The amount of the KOH solution used at this time is regarded as S (mL). A blank value is simultaneously measured, and the amount of the KOH solution used at this time is regarded as B (mL), and an acid value of the sample is calculated based on the following Equation (1), where, f is a KOH factor.

$$\text{Acid Value (mgKOH/g)} = [(S-B)\times f\times 5.61]/W \qquad \text{Equation (1)}$$

The hydroxyl value of the polyester is preferably 5 mgKOH/g or higher, more preferably 10 mgKOH/g to 120 mgKOH/g, and more preferably 20 mgKOH/g to 80 mgKOH/g. When the hydroxyl value is lower than 5 mgKOH/g, it may be difficult to simultaneously achieve the heat resistant storage stability and low temperature fixability of the toner.

The hydroxyl value of the binder resin is measured according to the basic procedure described in JIS K-0070, similarly to the above.

As described above, the polyester used as the main component of the binder resin in the present invention contains a resin (unmodified polyester) containing a polyester bond obtained by condensation polymerization of an alcohol component and a carboxylic acid component, and a modified polyester having a bond unit other than the polyester bond.

Meanwhile, as the binder resin component other than polyester, various types of resin can be used as required.

Examples of the binder resin component other than polyester include styrene (e.g., polystyrene, poly(p-chlorostyrene), and polyvinyltoluene) or polymers of substitution products thereof; styrene-based copolymers (e.g., styrene-p-chlorostyrene copolymers, styrene-propylene copolymers, styrene-vinyltoluene copolymers, styrene-methylacrylate copolymers, styrene-ethylacrylate copolymers, styrene-methacrylic acid copolymers, styrene-methylmethacrylate copolymers, styrene-ethylmethacrylate copolymers, styrene-butylmethacrylate copolymers, styrene-α-chloromethyl acrylate copolymers, styrene-acrylonitrile copolymers, styrene-vinyl methylethylketone copolymers, styrene-butadiene copolymers, styrene-isoprene copolymers, styrene-acrylonitrile-indene copolymers, styrene-maleic acid copolymers, and styrene-maleic acid ester copolymers); polymethyl methacrylate resins, polybutyl methacrylate resins, polyvinyl chloride resins, polyvinyl acetate resins, polyethylene resins, polyester resins, polyurethane resins, epoxy resins, epoxy polyol resins, polyurethane, polyamide, polyvinyl butyral resins, polyacrylic acid resins, rosin resins, modified rosin resins, terpene resins, aliphatic or aromatic hydrocarbon resins, aromatic petroleum resins, chlorinated paraffin, and paraffin waxes. These may be used alone or used in combination in the form of a mixture together with the polyester.

In the present invention, as the polyester, an unmodified polyester and/or a modified polyester can be used.

As described above, an unmodified polyester and a modified polyester can be used in combination. By using an unmodified polyester, for example, the low temperature fixability and the glossiness in the case of using a full color image forming apparatus are improved. Note that when an unmodified polyester is used in combination, it is preferable to use a modified polyester having an analogous constituent to that of the unmodified polyester, in terms of the low temperature fixability, and the hot offset resistance.

In the present invention, as the modified polyester, it is possible to use polymer produced by one-shot method, prepolymer method or the like.

With use of a modified polyester, the molecular weight of polymer components thereof can be easily controlled, and in a dry toner, particularly, oilless low temperature fixability (a wide-range releasability without the necessity of using a releasable-oil application mechanism to a heating medium for fixing, and fixability) can be ensured.

As the modified polyester, styrene-modified polyester or olefin-modified polyester can be used.

The styrene-modified polyester or olefin-modified polyester may be a resin obtained by modification of a polyester resin with a styrene resin or olefin resin, or a resin obtained by modification of a styrene resin or olefin resin with a polyester resin. Such a styrene-modified polyester or olefin-modified polyester can be obtained by synthesis, or commercially available products may also be used.

As the modified polyester, a resin formed of a resin precursor (a resin formed using an active hydrogen-containing compound and a polymer having a functional group reactive with the active hydrogen group of the active hydrogen-containing compound) can be used.

As the polymer, a polyester having a functional group reactive with an active hydrogen group is preferably used. By reacting an active hydrogen-containing compound with the polymer having a functional group reactive with the active hydrogen group of the active hydrogen-containing compound, it is possible to obtain a toner containing base particles further excellent in hot offset resistance.

When the toner composition liquid contains an unmodified polyester together with the polyester having a functional group reactive with an active hydrogen group, a mass ratio [(B)/(A)] of the polyester (B) having a functional group reactive with an active hydrogen group to an unmodified polyester (A) is preferably 1/19 to 3/1.

When the mass ratio [(B)/(A)] is less than 1/19, the effect of hot offset resistance may be insufficient, and when the mass ratio is more than 3/1, it may adversely affect the low temperature fixability.

Through the reaction of the active hydrogen-containing compound, and the polymer reactive with the active hydrogen group (which may be abbreviated as "polyester prepolymer"), the modified polyester can be obtained.

Examples of the polyester having a functional group reactive with an active hydrogen group include polyester prepolymers having an isocyanate group or an epoxy group, a carboxy group, —COCl group and the like. Among these groups, isocyanate groups are preferable because a urea-modified polyester can be obtained through a reaction with an active hydrogen-containing compound (amines). Particularly, a urea-modified polyester enables suppressing the adhesiveness to heating media for fixing, while maintaining high flowability and high transparency in the fixing temperature range of the unmodified polyester itself. That is, by incorporating a modified polyester, in which a polyester having an isocyanate group is subjected to a chain extension reaction with an active hydrogen-containing compound (amines), into the binder resin, it is possible to widen the difference between the minimum fixing temperature and the hot offset occurrence temperature and to contribute to the improvement in releasability range width.

Such a polyester having a functional group reactive with an active hydrogen group can be easily synthesized by a reaction between a conventionally known isocyanating agent and the polyester prepolymer serving as a base.

Examples of the isocyanating agent include aliphatic polyisocyanates (e.g., tetramethylene diisocyanate, hexamethylene diisocyanate, and 2,6-diisocyanatomethyl caproate); alicyclic polyisocyanates (e.g., isophorone diisocyanate, and cyclohexyl methane diisocyanate); aromatic diisocyanates (tolylene diisocyanate, diphenylmethane diisocyanate); aromatic aliphatic diisocyanates (e.g., α,α,α',α'-tetramethylxylene diisocyanate); isocyanurates; compounds obtained by blocking the polyisocyanate with a phenol derivative, oxime, caprolactam or the like; and mixtures thereof.

The urea-modified polyester can be obtained by a reaction between a polyester prepolymer having an isocyanate group and amines, and as the amines, there my be exemplified diamine compounds, trivalent or more polyamine compounds, amino alcohol compounds, amino mercaptan compounds, amino acid compounds, and compounds obtained by blocking an amino group of these compounds.

Examples of the diamine compounds include aromatic diamines (e.g., phenylenediamine, diethyltoluenediamine, diethyltoluenediamine, 4,4'-diaminodiphenylmethane); alicyclic diamines (4,4'-diamino-3,3'-dimethyldicyclohexylmethane, diaminocyclohexane, and isophoronediamine); and aliphatic diamines (e.g., ethylenediamine, tetramethylenediamine, and hexamethylenediamine).

Examples of the trivalent or more polyamine compounds include diethylene triamine, and triethylenetetramine.

Examples of the amino alcohol compounds include ethanolamine, and hydroxyethyl aniline.

Examples of the amino mercaptan compounds include aminoethyl mercaptan, and aminopropyl mercaptan.

Examples of the amino acid compounds include aminopropionic acid, and aminocaproic acids.

Examples of the compounds obtained by blocking an amino group of these compounds include ketimine compounds obtained from the amines and ketones (e.g., acetone, methyl ethyl ketone, and methyl isobutyl ketone), and oxazoline compounds.

Of these amines, preferred are diamine compounds, and a mixture of a diamine compound and a small amount of a polyamine compound. In addition, amines may also be used as a crosslinking agent and a chain extension agent.

Further, a chain terminator may be used to control the molecular weight of the modified polyester (urea-modified polyester). Examples of the chain terminator include monoamine (diethylamine, dibutylamine, butylamine, and laurylamine); and ketimine compounds obtained by blocking an amino group of the monoamines.

The mixing ratio of the amines, as an equivalent ratio [NCO]/[NHx] of isocyanate group [NCO] content in the modified polyester to amino group [NHx] content in the amines, is typically 1/2 to 2/1, preferably 1.5/1 to 1/1.5, and more preferably 1.2/1 to 1/1.2. When the equivalent ratio [NCO]/[NHx] is more than 2 or less than ½, the molecular weight of the urea-modified polyester decreases after the chain extension reaction, and the hot offset resistance of the toner may degrade.

The reaction time is suitably selected according to the reactivity depending on a combination of an isocyanate group possessed by the polyester prepolymer and amines, however, the reaction time is typically 10 minutes to 40 hours, and more preferably 2 hours to 24 hours. The reaction temperature is typically 0° C. to 150° C., and 40° C. to 98° C. In accordance with the necessity, known catalysts such as dibutyltin laurate, and dioctyltin laurate may be used.

Note that when the urea-modified polyester is synthesized, alcohols may be added in addition to amines to form a urethane bond. The molar ratio of the urethane bond to the urea bond generated as above is preferably 0 to 9, more preferably 1/4 to 4/1, and still more preferably 2/3 to 7/3. When the molar ratio is greater than 9, the hot offset resistance of the toner may degrade.

In the present invention, the modified polyester (urea-modified polyester) may contain a urethane bond together with the urea bond. The molar ratio of urea bond content to urethane bond content in the modified polyester is typically 100/0 to 10/90, preferably 80/20 to 20/80, and still more preferably 60/40 to 30/70. When the molar ratio of urea bond content is less than 10%, the hot offset resistance of the toner degrades.

The weight average molecular weight of the urea-modified polyester is not particularly limited. It is, however, preferably 10,000 or more, preferably 20,000 to 10,000,000, and more preferably 30,000 to 1,000,000. When the weight average molecular weight of the urea-modified polyester is less than 10,000, the hot offset resistance of the toner degrades. When the urea-modified polyester is used in combination with an unmodified polyester, the weight average molecular weight of the urea-modified polyester is not particularly limited, and it may be a number average molecular weight by which the above-mentioned weight average molecular weight is easily obtainable.

The amount of the isocyanating agent when the isocyanate group-containing polyester is obtained, as an equivalent ratio [NCO]/[OH] of isocyanate group [NCO] content to hydroxyl group [OH] content in the polyester serving as a base, is typically 5/1 to 1/1, preferably 4/1 to 1.2/1, and still more preferably 2.5/1 to 1.5/1. When the equivalent ratio [NCO]/[OH] is more than 5, the low temperature fixability of the toner degrades. When the molar ratio of [NCO] is less than 1, the urea content in the modified polyester is reduced, and the hot offset resistance of the toner degrades.

The amount of the isocyanating agent contained in the modified polyester is typically 0.5% by mass to 40% by mass, preferably 1% by mass to 30% by mass, and still more preferably 2% by mass to 20% by mass. When the isocyanating agent content is less than 0.5% by mass, it is disadvantageous in simultaneously achieving both the heat resistant storage stability and the low temperature fixability, in addition to degradation in the hot offset resistance. In contrast, when the isocyanating agent content is more than 40% by mass, the low temperature fixability may degrade.

Further, a crystalline polyester can be incorporated as a polymer into the binder resin. In this case, it is important for the crystalline polyester to be insoluble in the organic solvent for use in the preparation of a toner composition liquid (oil phase)) and in the formation of base particles by emulsifying or dispersing the oil phase in an aqueous medium (aqueous phase).

The crystalline polyester is the one obtained by a reaction between an alcohol component and an acid component, and a polyester having at least a melting point. In the present invention, the melting point of the crystalline polymer [corresponding to a peak endothermic temperature measured by differential scanning calorimetry (DSC)] is preferably 60° C. to 110° C. When the melting point is lower than 60° C., the heat resistant storage stability degrades, and toner blocking easily occurs at a temperature inside a developing device. In contrast, the peak endothermic temperature is higher than 110° C., sufficient low temperature fixability cannot be obtained due to the increase in the minimum fixing temperature.

[Releasing Agent]

The releasing agent is not particularly limited and may be suitably selected from among those known in the art in accordance with the intended use. For example, waxes are preferably exemplified.

Examples of the waxes include hydrocarbon-based waxes and carbonyl group-containing waxes. Among these, hydrocarbon-based waxes are particularly preferable. Examples of the hydrocarbon-based waxes include polyethylene waxes, polypropylene waxes, paraffin waxes, and Sazole waxes.

Specific examples of the carbonyl group-containing waxes include polyalkanoic acid ester, polyalkanol ester, polyalkanoic acid amide, polyalkylamide, and dialkyl ketone.

Examples of the polyalkanoic acid ester include carnauba wax, montan wax, trimethylolpropane tribehenate, pentaerythritol tetrabehenate, pentaerithritol diacetatedibehenate, glycerin tribehenate, 1,18-octadecandiol distearate.

Examples of the polyalkanoic acid amide include dibehenylamide.

Examples of the polyalkanol ester include trimellitic acid tristearyl, and distearyl maleate.

Examples of the polyalkylamide include trimellitic acid tristearylamide.

Examples of the dialkylketone include distearylketone.

The melting point of the releasing agent is not particularly limited and may be suitably selected in accordance with the intended use. It is, however, preferably 50° C. or higher, more preferably 60° C. to 160° C., and still more preferably 70° C. to 120° C. When the melting point is lower than 50° C., the wax may adversely affect the heat resistant storage stability. When the melting point is higher than 160° C., cold offset is liable to occur during fixing under low temperature conditions. Note that the melting point of the releasing agent is measured by differential scanning calorimetry (DSC), similarly to the melting point of the crystalline polyester.

The melt viscosity of the releasing agent, as a measured value at a temperature 20° C. higher than the melting point of the wax, is preferably 5 mPa·s to 500 mPa·s, and more preferably 10 mPa·s to 100 mPa·s. When the melt viscosity of the releasing agent is less than 5 mPa·s, the releasability may degrade, and when it is more than 500 mPa·s, the effect of improving the hot offset resistance and low temperature fixability may not be obtained.

The melt viscosity of the releasing agent is measured using, for example, a B-type rotational viscometer.

The amount of the releasing agent contained in the toner is not particularly limited and may be suitably selected in accordance with the intended use. It is, however, preferably 0% by mass to 40% by mass, and more preferably 3% by mass to 30% by mass. When the amount of the releasing agent exceeds 40% by mass, the flowability of the toner may degrade.

As described above, the method for producing a toner of the present invention includes dissolving or dispersing, in an organic solvent, a binder resin containing at least polyester as the main component, a colorant masterbatch obtained by melt-kneading an organic pigment-containing colorant and a colorant dispersion resin which has a weight average molecular weight (Mw) 5,000 to 50,000 and contains polyester containing an amide bond structure; and a releasing agent to prepare a toner composition liquid (oil phase); and emulsifying or dispersing the oil phase in an aqueous medium (aqueous phase), in which resin fine particles have been dispersed, to prepare an emulsion or a dispersion liquid, and then removing the solvent from the emulsion or dispersion liquid to thereby form base particles.

In the present invention, a binder resin, a masterbatch which is obtained by melt-kneading an organic pigment-containing colorant and a colorant dispersion resin containing a polyester having a weight average molecular weight (Mw) of 5,000 to 50,000 and containing an amide bond structure, and a releasing agent are dissolved or dispersed in an organic solvent to prepare a toner composition liquid, and the toner composition liquid is emulsified or dispersed in an aqueous medium, in which resin fine particles have been dispersed, and thereby the toner composition liquid can contain a resin precursor. Through the reaction of the resin precursor, the binder resin can be incorporated into the toner composition liquid. That is, the toner composition liquid can contain, as a resin precursor, an active hydrogen-containing compound and a polymer having a functional group reactive with the active hydrogen group (may be referred to as "polyester prepolymer"), and contains a modified polyester obtained by a reaction the polyester prepolymer and the active hydrogen-containing compound as a binder resin.

Note that the toner composition liquid may contain the after mentioned toner material composition liquid (which may be referred to as "toner material") (for example, a charge controlling agent), other than the toner materials described above.

The following describes the case where a polyester having an isocyanate group is used as the polyester having a functional group reactive with the active hydrogen group, and reacted with the active hydrogen-containing compound (amines) to thereby form a modified polyester (urea-modified polyester). Specifically, the following describes a method of obtaining toner base particles through a reaction of a polyester [polyester prepolymer (a)] having an isocyanate group with an active hydrogen-containing compound [amines (b)].

As the method of obtaining toner base particles, there may be exemplified a method in which a colorant dispersion resin containing a polyester [which contains amines (b) as one of constituents, and a polyester prepolymer (a)], an organic pigment-containing colorant and a polymer containing an amide bond structure and having a weight average molecular weight (Mw) of 5,000 to 50,000 is melt kneaded to prepare a colorant masterbatch; a toner material composition containing the colorant masterbatch and a releasing agent is dissolved or dispersed in an organic solvent to prepare a toner composition liquid; the toner composition liquid is emulsified or dispersed in an aqueous medium in which resin fine particles have been dispersed, followed by removing the organic solvent, washing, and drying after or while the polyester prepolymer (a) is reacted with the amines (b).

Here, besides the toner material, the toner composition liquid may contain an unmodified polyester, a crystalline polyester, and other components. As the other components, for example, a charge controlling agent is used. Such other components may be mixed in the organic solvent when the toner composition liquid is prepared, however, it is preferable that after the toner composition liquid is prepared using the toner material composition, they be dissolved or dispersed in the toner composition liquid. Note that some of the other toner materials (e.g., charge controlling agent) are not necessarily mixed in the aqueous medium (aqueous phase) in which resin fine particles have been dispersed at the time of emulsifying or dispersing the toner composition liquid in the aqueous medium, and may be added after the toner composition liquid is emulsified or dispersed in the aqueous medium.

[Resin Fine Particles]

In the present invention, the resin fine particles dispersed in the aqueous medium is not particularly limited, as long as it is a resin capable of forming an aqueous dispersion liquid in the aqueous medium, and may be suitably selected from among known resins in accordance with the intended use. For example, the resin fine particles may be a thermoplastic resin and a thermosetting resin. Examples thereof include vinyl resins, polyurethane resins, epoxy resins, polyester resins, polyamide resins, polyimide resins, silicon resins, phenol resins, melamine resins, urea resins, aniline resins, ionomer resins, and polycarbonate resins.

These resins may be used alone or in combination. Among these, from the viewpoint that an aqueous dispersion liquid containing fine and spherical shape resin particles can be easily obtained, the resin fine particles are preferably formed of at least one selected from vinyl resins, polyurethane resins, epoxy resins and polyester resins.

Note that the vinyl resin is a polymer obtained by monopolymerization or copolymerization of a vinyl monomer. Examples thereof include a styrene-(meth)acrylic acid ester resin, a styrene-butadiene copolymer, a (meth)acrylic acid-acrylic acid ester polymer, a styrene-acrylonitrile copolymer, a styrene-maleic anhydride copolymer, and a styrene-(meth) acrylic acid copolymer.

As the resin fine particles, a copolymer containing a monomer having at least two unsaturated groups may also be used.

The monomer having at least two unsaturated groups is not particularly limited and may be suitably selected in accordance with the intended use. Specific examples thereof include sodium salt of methacrylic acid ethylene oxide adduct sulfate ester ("ELEMINOL RS-30" produced by Sanyo Chemical Industries, Ltd.), divinylbenzene, and 1,6-hexanediol acrylate.

The resin fine particles can be obtained through polymerization by a known method suitably selected suitably selected in accordance with the purpose, however, it is preferably obtain the fine particles in the form of an aqueous dispersion liquid of the resin fine particles. As a suitable method of preparing the aqueous dispersion liquid of the resin fine particles, the following methods are exemplified:

(i) In the case of the vinyl resin, a method in which a vinyl monomer is used as a starting material and is subjected to any one of polymerization reactions selected from a suspension polymerization method, an emulsification polymerization method, a seed polymerization method and a dispersion polymerization method, to thereby directly produce an aqueous dispersion liquid of resin fine particles;

(ii) In the case of a polyaddition or condensation-type resin, such as the polyester resin, polyurethane resin and epoxy resin, a method in which a precursor (monomer, oligomer, etc.) or a solvent solution thereof is dispersed in an aqueous medium in the presence of a proper dispersant, and then the resulting dispersion liquid is heated or, a hardener is added thereto so as to be hardened, to thereby produce an aqueous dispersion of resin fine particles;

(iii) In the case of a polyaddition or condensation-type resin, such as the polyester resin, polyurethane resin and epoxy resin, a method in which a proper emulsifier is dissolved in a precursor (monomer, oligomer, etc.) or a solvent solution thereof (which is preferably a liquid, or may be formed in a liquid by heating), followed by addition of water to thereby perform phase reversal of emulsion;

(iv) A method in which a resin which is preliminarily produced by a polymerization reaction (which may be any one of addition polymerization, ring-opening polymerization, polyaddition, polycondensation, and condensation polymerization) is pulverized by a mechanical rotation type or jet type micro-pulverizer, then subjected to classification to obtain resin fine particles, and dispersed in water, in the presence of a proper dispersant;

(v) A method in which a resin preliminarily produced by a polymerization reaction (which may be any one of addition polymerization, ring-opening polymerization, polyaddition, polycondensation, and condensation polymerization) is dissolved in a solvent to prepare a resin solution, the resin solution is sprayed in the form of mist to obtain resin fine particles, and the resin fine particles are dispersed in water in the presence of a proper dispersant;

(vi) A method in which a resin preliminarily produced by a polymerization reaction (which may be any one of addition polymerization, ring-opening polymerization, polyaddition, polycondensation, and condensation polymerization) is dissolved in a solvent to prepare a resin solution, a poor solvent is added to the resin solution, or a resin solution which is preliminarily dissolved in a solvent by heating, followed by cooling so as to precipitate resin fine particles, subsequently the solvent is removed from the resin solution to obtain resin fine particles, and then the resin fine particles are dispersed in water in the presence of a proper dispersant;

(vii) A method in which a resin preliminarily produced by a polymerization reaction (which may be any one of addition polymerization, ring-opening polymerization, polyaddition, polycondensation, and condensation polymerization) is dissolved in a solvent to prepare a resin solution, the resin solution is dispersed in an aqueous medium in the presence of a proper dispersant, and then the solvent is removed therefrom under heating or a reduced pressure; and (viii) A method in which a resin preliminarily produced by a polymerization reaction (which may be any one of addition polymerization, ring-opening polymerization, polyaddition, polycondensation, and condensation polymerization) is dissolved in a solvent to prepare a resin solution, a proper emulsifier is dissolved in the resin solution, and then water is added to the resin solution to thereby perform phase reversal of emulsion.

In addition, it is preferable to use a dispersant in the aqueous medium as required, from the viewpoint of stabilizing oil droplets of the solution or dispersion liquid in after-mentioned emulsification or dispersion process and obtaining a sharper particle size distribution while obtaining a desired shape of the resin fine particles.

The dispersant is not particularly limited and may be suitably selected in accordance with the intended use. Examples thereof include surfactants, water-sparing soluble inorganic compound dispersants, and polymer-based protective colloids.

These dispersants may be used alone or in combination. Among these, surfactants are preferable.

Examples of the surfactants include anionic surfactants, cationic surfactants, nonionic surfactants, and amphoteric surfactants.

Specific examples of the anionic surfactants include alkylbenzene sulfonic acid salts, α-olefin sulfonic acid salts, phosphates, and anionic surfactants having a fluoroalkyl group, with the anionic surfactants having a fluoroalkyl group being preferred. Specific examples of the anionic surfactants having a fluoroalkyl group include fluoroalkyl carboxylic acids having 2 to 10 carbon atoms or metal salts thereof, disodium perfluorooctane sulfonyl glutamic acid, sodium 3-[omega-fluoroalkyl (C6 to C11)oxy]-1-alkyl(C3 to C4)sulfonate, sodium 3-[omega-fluoroalkanoyl (C6 to C8)-N-ethylamino]-1-propane sulfonate, fluoroalkyl (C11 to C20) carboxylic acids or metal salts thereof, perfluoroalkyl carboxylic acids (C7 to C13) or metal salts thereof, perfluoroalkyl (C4 to C12) sulfonic acids or metal salts thereof, perfluorooctane sulfonic acid diethanolamide, N-propyl-N-(2-hydroxyethyl) perfluorooctane sulfonamide, perfluoroalkyl (C6 to C10)sulfonamide propyl trimethylammonium salts, perfluoroalkyl (C6 to C10)-N-ethylsulfonyl glycin salts, and mono-perfluoroalkyl (C6 to C16)ethyl phosphate. Examples of commercially available products of the anionic surfactants having a fluoroalkyl group include SURFLON S-111, S-112, and S-113 (manufactured by Asahi Glass Co., Ltd); FLUORAD FC-93, FC-95, FC-98, and FC-129 (manufactured by Sumitomo 3M Co., Ltd); UNIDINE DS-101, and DS-102 (manufactured by Daikin Industries, Ltd); MEGAFACE F-110, F-120, F-113, F-191, F-812, and F-833 (manufactured by Dainippon Ink & Chemicals, Inc.); F-TOP EF-102, 103, 104, 105, 112, 123A, 123B, 306A, 501, 201, and 204 (manufactured by Tochem Products Co., Ltd); and FTERGENT F-100 and F150 (manufactured by Neos Co., Ltd).

Examples of the cationic surfactants include amine salt-type surfactants, quaternary ammonium salt-type cationic surfactants, and fluoroalkyl group-containing cationic surfactants. Specific examples of the amine salt-type surfactants include alkylamine salts, amino alcohol fatty acid derivatives, polyamine fatty acid derivatives, and imidazoline. Specific examples of the quaternary ammonium salt-type cationic surfactants include alkyltrimethyl ammonium salt, dialkyldimethyl ammonium salt, alkyldimethylbenzyl ammonium salts, pyridinium salt, alkylisoquinolinium salt, and benzethonium chloride. Specific examples of the fluoroalkyl group-containing cationic surfactants include aliphatic primary, secondary, or tertiary amine having a fluoroalkyl group, aliphatic quaternary ammonium salt (e.g., perfluoroalkyl (C6 to C10) sulfonamide propyl trimethyl ammonium salt), benzalkonium salt, benzethonium chloride, pyridinium salt, and imidazolinium salt.

Examples of commercially available products of the cationic surfactant include SURFLON S-121 (manufactured by Asahi Glass Co., Ltd); FLUORAD FC-135 (manufactured by Sumitomo 3M Co., Ltd); UNIDINE DS-202 (manufactured by Daikin Industries, Ltd), MEGAFACE F-150, and F-824 (manufactured by Dainippon Ink & Chemicals, Inc.); F-TOP EF-132 (manufactured by Tochem Products Co., Ltd); and FTERGENT F-300 (manufactured by Neos Co., Ltd).

—Charge Controlling Agent—

The charge controlling agent is not particularly limited and may be suitably selected from among known charge controlling agents in accordance with the intended use. However, when a colored material is used, the color tone may be changed, and thus a colorless material or a material close to white color is preferable. Examples thereof include triphenylmethane-based dyes, molybdenum acid chelate pigments, rhodamine-based dyes, alkoxy-based amines, quaternary ammonium salts (including fluorine-modified quaternary ammonium salt), alkylamide, single substance or compounds of phosphorous, single substance or compounds of tungsten, fluorine-based active agents, salicylic metal salts, and metal salts of salicylic acid derivatives. These may be used alone or in combination.

For the charge controlling agent, commercially available products may be used. Examples of the commercially available products include BONTRON P-51 of quaternary ammonium salt, BONTRON E-82 of oxy naphthoic acid-based metal complex, E-84 of salicylic acid-based metal complex, and BONTRON E-89 of phenolic condensate (produced by ORIENT CHEMICAL); TP-302 and TP-415 of quaternary ammonium salt molybdenum complex (produced by HODOGAYA CHEMICAL); COPY CHARGE PSY VP2038 of quaternary ammonium salt, COPY BLUE PR of triphenyl methane derivative, COPY CHARGE NEG VP2036 of quaternary ammonium salt, and COPY CHARGE NX VP434 (produced by Hoechst AG); LRA-901, and LR-147 of boron complex (produced by NIPPON CARLIT); quinacridone, and azo pigments; and other polymer compounds having a functional group such as a sulfonic group, carboxyl group, and quaternary ammonium salt.

The charge controlling agent may be melt-kneaded together with the colorant masterbatch and then dissolved or dispersed in the organic solvent, or may be directly added together with each of the toner components in the organic solvent when the colorant masterbatch is dissolved or dispersed in the organic solvent, or after base particles are produced, the charge controlling agent may be fixed on surfaces of the base particles to form a toner having toner base particles.

The charge controlling agent content in the toner varies depending on the type of the binder resin, the presence or absence of additives, the dispersion method employed and the like, and cannot unequivocally defined, however, it is preferably 0.1 parts by mass to 10 parts by mass, and more preferably 0.2 parts by mass to 5 parts by mass per 100 parts by mass of the binder resin. When the charge controlling agent content is less than 0.1 parts by mass, the charge controllability may not be obtained. When the charge controlling agent content is more than 10 parts by mass, the effect of the charge controlling agent is diminished due to excessively high chargeability of the toner, and the electrostatic attraction force of the toner to a developing roller used increases, which may cause a degradation in flowability of the developer and degradation in image density.

Further, when a toner having base particles is produced, other components such as inorganic fine particles, a flowability improver, a cleanability improver, a magnetic material and a metal soap are used as required.

The inorganic fine particles used as required when a toner having base particles is produced is not particularly limited and may be suitably selected from among known materials in accordance with the intended use. Examples thereof include silica, alumina, titanium oxide, barium titanate, magnesium titanate, calcium titanate, strontium titanate, zinc oxide, tin oxide, silica sand, clay, mica, wollastonite, diatomite, chromium oxide, cerium oxide, colcothar, antimony trioxide, magnesium oxide, zirconium oxide, barium sulfate, barium carbonate, calcium carbonate, silicon carbide, silicon nitride. These may be used alone or in combination.

The primary particle diameter of the inorganic fine particles is preferably 5 nm to 2 μm, and more preferably 5 nm to 500 nm. The specific surface area of the inorganic fine particles determined by BET method is preferably 20 $m^2/g$ to 500 $m^2/g$.

The amount of the inorganic fine particles contained in the toner is preferably 0.01% by mass to 5.0% by mass.

The flowability improver used as required when a toner having base particles is produced is a material which is used for a surface treatment for improving the hydrophobicity and capable of preventing degradation in flowability and chargeability of the toner even under high humidity conditions. Examples thereof include silane coupling agent, silylating agent, silane coupling agent having fluorinated alkyl group(s), organic titanate coupling agent, aluminum coupling agent, silicone oil, and modified silicone oil.

The cleanability improver used as required when a toner having base particles is produced is added to the base particles for removing an untransferred developer remaining a photoconductor and a primary transfer medium after being transferred. Examples thereof include fatty acid metal salts (e.g., zinc stearate, calcium stearate, and stearic acid); and polymer fine particles produced by soap-free emulsification polymerization (e.g., polymethylmethacrylate fine particles, and polystyrene fine particles). The polymer fine particles preferably have a relatively narrow particle size distribution, and those having a volume average particle diameter of 0.01 μm to 1 μm are preferable.

Further, the magnetic material used as required when a toner having base particles is produced is not particularly limited and may be suitably selected from among known magnetic materials in accordance with the intended use. Examples thereof include iron powder, magnetite, and ferrite. Among these, magnetic materials of white color are preferable in terms of the color tone.

(Developer)

The toner having base particles (toner) according to the present invention can be used for a one-component developer or two-component developer.

When the toner of the present invention is used for a two-component developer, the toner may be mixed with a magnetic carrier, and the content ratio of the carrier and the toner in the developer is preferably 1 part by mass to 10 parts by mass of the toner relative to 100 parts by mass of the carrier.

As for the magnetic carrier, conventionally known magnetic carriers, such as iron powder, ferrite powder, magnetite powder and magnetic resin carrier each having a particle diameter of about 20 μm to about 200 μm, can be used.

Examples of a coating material usable for coating the magnetic carrier include amino-based resins (e.g., urea-formaldehyde resin, melamine resin, benzoguanamine resin, urea resin, polyamide resin, and epoxy resin); polyvinyl and polyvinylidene-based resins (e.g., acrylic resin, polymethylmethacrylate resin, polyacrylonitrile resin, polyvinyl acetate resin, polyvinyl alcohol resin, and polyvinyl butyral resin); polystyrene-based resins (e.g., polystyrene resin, and styrene-acrylate copolymer resin); halogenated olefin resins (e.g., polyvinyl chloride); polyester-based resins (e.g., polyethylene terephthalate resin, and polybutylene terephthalate resin); polycarbonate-based resins, polyethylene resins, polyvinyl fluoride resins, polyvinylidene fluoride resins, polytrifluoroethylene resins, polyhexafluoropropylene resins, copolymers of vinylidene fluoride with an acrylic monomer, copolymers of vinylidene fluoride with vinyl fluoride, fluoroterpolymers (e.g., terpolymer of tetrafluoroethylene, vinylidene fluoride and non-fluoro monomer); and silicone resins.

As necessary, a conductive powder etc. may be added in the coating resin. As the conductive powder, for example, metal powder, carbon black, titanium oxide powder, tin oxide powder, zinc oxide powder, aluminum oxide powder, and a silica powder can be used. These conductive powders preferably have an average particle diameter of 1 μm or smaller. When the average particle diameter of the conductive powder is greater than 1 μm, it is difficult to control the electric resistance of the toner.

In addition, the toner of the present invention can also be used as a one-component developer (magnetic toner or non-magnetic toner) without using carrier.

<Image Forming Method>

An image forming method used in the present invention includes at least charging a surface of an image bearing member, developing a latent electrostatic image formed on the charged image bearing member using a developer (one-component developer) containing the toner or a developer (two component developer), the toner and a developer (one component or a developer, transferring a toner image formed of the image bearing member onto a toner image, and fixing the toner image on the support With use of the image forming method, it is possible to continuously form an image causing less occurrence of background smear nonuniformity image density, with stability and form an image excellent on permeability on an OHP sheet without substantially causing scattered reflection.

EXAMPLES

Hereinafter, the present invention will be further described with reference to Examples and Comparative Examples, however, these Examples shall not be construed as limiting the scope of the present invention. Note that the unit "part(s) described below means "part(s) by mass".

<Molecular Weight of Resin Used>

The weight average molecular weight (Mw) and the number average molecular weight (Mn) of resins were measured according to the following procedure.

[Measurement of Weight Average Molecular Weight (Mw)]

The mass average molecular weight of a binder resin was measured by GPC (Gel Permeation Chromatography) under the following conditions:

Device: GPC-150C (manufactured by Waters Instruments, Inc.)

Column: KF801 to KF807 (manufactured by Showdex Co.)

Temperature: 40° C.

Solvent: THF (tetrahydrofuran)

Rate of flow: 1.0 mL/min

Sample: 0.1 mL of a sample having a concentration of 0.05% to 0.6% was injected into the column.

Based on a molecular weight distribution of the binder resin measured under the above conditions, a mass average molecular weight of the binder resin was calculated from a molecular weight calibration curve created using a monodispersed polystyrene provided as a standard sample.

[Measurement of Number Average Molecular Weight (Mn)]

The number average molecular weight of the binder resin was measured by GPC under the following conditions:

Device: GPC-150C (manufactured by Waters Instruments, Inc.)

Column: KF801 to KF807 (manufactured by Showdex Co.)

Temperature: 40° C.

Solvent: THF (tetrahydrofuran)

Rate of flow: 1.0 mL/min

Sample: 0.1 mL of a sample having a concentration of 0.05% to 0.6% was injected.

When 1 g of a sample (binder resin) was added to 100 mL of THF, and the solvent insoluble fraction was 75% by mass or more, DMF (dimethylformamide) was used as a solvent. The number average molecular weight of the binder resin was calculated from a molecular weight calibration curve created using a monodispersed polystyrene provided as a standard sample.

<Tg of Toner>

The Tg (DSC maximum endothermic peak) of the image forming toner was calculated from a tangent point between a tangent line of an endothermic curve near the melting point and a base line thereof, using a TG-DSC system (TAS-100) (manufactured by Rigaku Corporation) and an analysis system in the TAS-100.

Specifically, about 10 mg of a toner sample was placed in an aluminum-sample container, the container was mounted on a holder unit of the TG-DSC system and then set in an electric oven. The toner sample was heated from room temperature to 180° C. at a temperature increase rate of 10° C./min, and then based on the obtained endothermic curve, a Tg was calculated.

<Solubility Test of Resin>

A binder resin (800 parts) and a colorant dispersion resin (200 parts) were charged to a HENSCHEL MIXER (20B, manufactured by Mitsui Mining Co., Ltd.), stirred at 1,500 rpm for 1 minute to obtain a mixture. The mixture was kneaded at 110° C. for 45 minutes using a two-roll to obtain a resin mixture. The resin mixture was pulverized with a mortar. The powder thus obtained was formed in a slice with a microtome (manufactured by Nisshin EM Co., Ltd.) and then observed through a transmission electron microscope (H7000, manufactured by Hitachi High-Technologies Corporation) at a magnification of 5,000 times. At this time, whether or not resin domains were present was examined, and when the size of the resin domain was 1 μm or smaller, it was recognized that the binder resin was dissolved.

<Crystallinity Evaluation Method>

The crystallinity of a crystalline resin was evaluated by the density, and measured by in-water substitution method according to JIS K7112-1999. Specifically, the resin was melted by heating and poured into a die (length: 10 cm, width: 10 cm, depth: 1 cm). Next, the weight of the test piece, which had been cooled, was measured, and then immersed in water to measure the volume. This process was repeated three times to obtain an average value, and the density (g/cm$^3$) of the test piece was determined from the average values. Then, a resin having a density of 1.25 g/cm$^3$ or more was regarded as a crystalline resin.

Example A1

Synthesis of Polyester Resin 1

Into a reaction vessel equipped with a thermometer, a stirrer, a condenser, and a nitrogen inlet tube, PO adduct of bisphenol A (product of propylene oxide being added to bisphenol A: hydroxyl value: 320 mgKOH/g) (443 parts), diethylene glycol (135 parts), terephthalic acid (422 parts), and dibutyltin oxide (2.5 parts) were added, reacted at 230° C. until the acid value reached 7 mgKOH/g. Further, the resin (410 parts) was charged to a reaction vessel equipped with a condenser tube, a stirrer and a nitrogen inlet tube, and isophorone diisocyanate (89 parts) and ethyl acetate (500 parts) were added and reacted at 100° C. for 5 hours to thereby obtain [Polyester Resin (hereinafter, described as "Pes1")].

—Production of Crystalline Polyester Resin 1—

[Pes1] (10 parts) was added to ethyl acetate (90 parts) so as to have a concentration of 10% by mass, and heated to 60° C. in a hot water bath. Subsequently, the hot water bath was switched off, and the mixture was left standing for 1 day while being slowly cooled to room temperature. A white turbid liquid thusly obtained was further dried for 1 day in a draft chamber to thereby obtain [Crystalline Polyester Resin (hereinafter, described as Cpes) 1]. Cpes 1 was found to be sparingly soluble.

(Preparation of Masterbatch 1)

Next, a dispersion liquid (Masterbatch 1), in which a colorant had been uniformly dispersed in advance in a part of [Pes1] for use in the formulation of toner, was prepared in the following manner.

The materials described in the following formulation of (Masterbatch 1) were mixed at 1,500 rpm for 3 minutes using a HENSCHEL MIXER (20B, manufactured by Mitsui Mining Co., Ltd.) to obtain a mixture, and the mixture was kneaded with a two-roll at 110° C. for 45 minutes, cool rolled and then pulverized with a pulverizer to obtain [Masterbatch 1]. [Masterbatch 1] thusly prepared (50 parts) and ethyl acetate (50 parts) were charged together with a zirconia bead (3 mmϕ, manufactured by NIKKATO Co. Ltd.) (300 parts) to a paint shaker, and stirred for 24 hours to thereby obtain [Masterbatch 1] (which may be referred to as "Masterbatch Dispersion Liquid 1].

(Formulation of Masterbatch 1).

water: 30 parts

Quinacridone pigment PR122 (produced by DIC): 50 parts

Pes1: 25 parts

Cpes1: 25 parts (Synthesis of Organic Fine Particle Emulsion)

Into a reaction vessel equipped with a stirrer and a thermometer, water (683 parts), sodium salt of methacrylic acid ethylene oxide adduct sulfate ester (ELEMINOL RS-30, produced by Sanyo Chemical Industries, Ltd.) (11 parts), styrene (83 parts), methacrylic acid (83 parts), butyl acrylate (110 parts), and ammonium persulfate (1 part) were charged and then stirred at 400 rpm for 15 minutes to obtain a white liquid emulsion. Then, the temperature of the reaction system was raised to 75° C. by heating and reacted for 5 hours. Further, a 1% by mass ammonium persulfate aqueous solution (30 parts) was added to the reaction system and aged at 75° C. for 5 hours to thereby obtain an aqueous dispersion liquid of a vinyl-based resin (a copolymer of styrene methacrylate-butyl acrylate-sodium salt of methacrylic acid ethylene oxide adduct sulfate ester) [Fine Particle Dispersion Liquid 1].

The average particle diameter of [Fine Particle Dispersion Liquid 1] was measured by a LA-920 (laser diffraction/scattering type particle size distribution measurement device, manufactured by HORIBA Ltd.) and found to be 105 nm. A part of [Fine Particle Dispersion Liquid 1] was dried so that the resin parts were isolated therefrom. The resin was found to have a weight average molecular weight of 150,000.

(Preparation of Aqueous Phase)

Water (990 parts), [Fine Particle Dispersion Liquid 1] (99 parts) and a 48.5% by mass aqueous solution of sodium dodecyldiphenyl ether disulfonate (35 parts) (ELEMINOL MON-7, produced by Sanyo Chemical Industries, Ltd.) and ethyl acetate (70 parts) were mixed and stirred to thereby obtain a white-milky liquid [Aqueous Phase 1].

(Synthesis of Intermediate Polyester)

Into a reaction vessel equipped with a condenser tube, a stirrer and a nitrogen inlet tube, ethylene oxide (2 mol) adduct of bisphenol A (682 parts), propylene oxide (2 mol) adduct of bisphenol A (81 parts), terephthalic acid (283 parts), trimellitic anhydride (22 parts) and dibutyltin oxide (2 parts) were added, reacted under normal pressure at 230° C. for 8 hours and further reacted under reduced pressure of 10 mmHg to 15 mmHg for 5 hours to thereby obtain [Intermediate Polyester 1]. [Intermediate Polyester 1] was found to have a number average molecular weight of 2,100, a weight average molecular weight of 9,500, a glass transition temperature (Tg) of 55° C., an acid value of 0.5 mgKOH/g, and a hydroxyl value of 51 mgKOH/g.

(Synthesis of Prepolymer 1)

Next, into a reaction vessel equipped with a condenser tube, a stirrer and a nitrogen inlet tube, [Intermediate Polyester 1] (410 parts), isophorone diisocyanate (89 parts), ethyl acetate (500 parts) were charged and reacted at 100° C. for 5 hours to obtain [Prepolymer 1].

(Synthesis of Ketimine)

Into a reaction vessel equipped with a stirrer and a thermometer, isophorone diamine (170 parts) and methylethylketone (75 parts) were charged and reacted at 50° C. for 5 hours to obtain [Ketimine Compound 1].

(Production of Oil Phase)

Into a vessel equipped with a stirrer and a thermometer, 160 parts of [Pes1], 32 parts of carnauba wax, and 400 parts of ethyl acetate were charged. The temperature of the reaction system was raised to 80° C. with stirring and maintained at 80° C. for 5 hours and then cooled to 30° C. over 1 hour. Next, in the vessel, 90 parts of [Masterbatch Dispersion Liquid 1] same as used in Example A1 were charged and mixed for 1 hour to obtain [Toner Material Solution 1] having a solid content of 50% by mass.

[Toner Material Solution 1] (464 parts) was transferred to a vessel, and the pigment and wax were dispersed with a bead mill (ULTRA VISCOMILL manufactured by Aimex Co., Ltd.) under the following conditions: liquid feed rate: 1 kg/hr, disc circumferential speed: 6 m/sec, 0.5 mm-zirconia bead filled at 80% by volume, and three passes. Subsequently, 420 parts of a 50% by mass ethyl acetate solution of [Pes1] were added to [Toner Material Solution 1] and passed through the bead mill once under the conditions described above, thereby obtaining

[Pigment/Wax Dispersion Liquid 1].

(Emulsification to Desolventation)

[Pigment/Wax Dispersion Liquid 1] (885 parts), 115 parts of [Prepolymer 1], 2.9 parts of [Ketimine Compound 1] were charted to a vessel, mixed at 5,000 rpm for 1 minute using a TK homomixer (manufactured by Tokushu Kikai Kogyo Co. Ltd.), and then 1,200 parts of [Aqueous Phase 1] were added to the vessel and mixed at 12,500 rpm for 30 minutes using the TK homomixer to obtain [Emulsion Slurry 1].

In a vessel equipped with a stirrer and a thermometer, [Emulsion Slurry 1] was charged, the solvent was removed at 35° C. for 7 hours, and then aged at 45° C. for 4 hours to obtain [Dispersion Slurry 1]. A sample was transferred to the TK homomixer at some midpoint in the desolventation and stirred at 12,500 rpm for 40 minutes so that the toner had an irregular shape.

(Washing to Drying)

After 100 parts of [Dispersion Slurry 1] was filtered under reduced pressure, (1): 100 parts of ion exchanged water were added to the resulting filtration cake and mixed at 12,000 rpm for 10 minutes using a TK homomixer, followed by a filtration treatment.

(2): Into the filtration cake prepared in (1), 100 parts of a 10% by mass sodium hydroxide aqueous solution were added, mixed at 12,000 rpm for 30 minutes using a TK homomixer and filtered under reduced pressure.

(3): Into the filtration cake prepared in (2), 100 parts of a 10% by mass hydrochloric acid were added, mixed at 12,000 rpm for 10 minutes using a TK homomixer and then filtered.

(4): Into the filtration cake prepared in (3), 300 parts of ion exchanged water were added, mixed at 12,000 rpm for 10 minutes using a TK homomixer and then filtered. This treatment was repeated two times, thereby obtaining [Filtration Cake 1].

(Production of Toner Base)

[Filtration Cake 1] was dried with a circular air-drier at 45° C. for 48 hours and sieved with a mesh with openings of 75 μm. Further, to 100 parts of the resulting particles, 0.6 parts of a charge controlling agent (E-84, salicylate metal salt, produced by Orient Chemical Industries Ltd.) were used and mixed at 1,000 rpm using a HENSCHEL MIXER, and further mixed at 5,500 rpm using a Q-type mixer (manufactured by Mitsui Metal Mining Co., Ltd.) so as to make the charge controlling agent adhere to the surface of the toner, thereby obtaining [Toner Base 1].

(Addition of External Additive)

Next, to 100 parts of [Toner Base 1], 0.7 parts of a hydrophobic titanium oxide were added and mixed with a HENSCHEL MIXER (manufactured by Hosokawa Micron K.K.) to obtain [Polymerized Toner 1] and the production of toner was completed.

Example A2

Production of Cpes2

[Cpes2] was produced in the same manner as in Example A1, except that in the production conditions for [Cpes1], the resin concentration was changed from 10% by mass to 1% by mass. Cpes2 was found to be sparingly soluble.

(Production of Polymerized Toner 2)

A toner was obtained in the same manner as in Example A1, except that [Masterbatch 2] was used, to which [Cpes2] had been added instead of [Cpes1] of [Masterbatch 1], thereby obtaining [Polymerized Toner 2].

Example A3

Production of Cpes3

[Cpes3] was produced in the same manner as in Example A1, except that in the production conditions for [Cpes1], the resin concentration was changed from 10% by mass to 0.1% by mass. Cpes3 was found to be sparingly soluble.

(Production of Polymerized Toner 3)

A toner was obtained in the same manner as in Example A1, except that [Masterbatch 3] was used, to which [Cpes2] had been added instead of [Cpes1] of [Masterbatch 1], thereby obtaining [Polymerized Toner 3].

Example A4

Synthesis of Pes2

Into a reaction vessel equipped with a thermometer, a stirrer, a condenser, and a nitrogen inlet tube, PO adduct of bisphenol A (product of propylene oxide being added to bisphenol A: hydroxyl value: 320 mgKOH/g) (443 parts), diethylene glycol (135 parts), terephthalic acid (422 parts), and dibutyltin oxide (2.5 parts) were added, reacted at 230° C. until the acid value reached 7 mgKOH/g. Further, the resin (410 parts) was charged to a reaction vessel equipped with a condenser tube, a stirrer and a nitrogen inlet tube, and isophorone diisocyanate (44 parts) and ethyl acetate (500 parts) were added and reacted at 100° C. for 5 hours to thereby obtain [Pes2].

(Production of Polymerized Toner 4)

A toner was obtained in the same manner as in Example A1, except that [Pes2] was used instead of [Pes1] used in the production of an oil phase, thereby obtaining [Polymerized Toner 4].

Example A5

A toner was obtained in the same manner as in Example A2, except that [Pes2] was used instead of [Pes1] used in the production of an oil phase, thereby obtaining [Polymerized Toner 5].

Example A6

A toner was obtained in the same manner as in Example A3, except that [Pes2] was used instead of [Pes1] used in the production of an oil phase, thereby obtaining [Polymerized Toner 6].

Example A7

Synthesis of Pes3

Into a reaction vessel equipped with a thermometer, a stirrer, a condenser, and a nitrogen inlet tube, PO adduct of bisphenol A (product of propylene oxide being added to bisphenol A: hydroxyl value: 320 mgKOH/g) (443 parts), diethylene glycol (135 parts), terephthalic acid (422 parts), and dibutyltin oxide (2.5 parts) were added, reacted at 230° C. until the acid value reached 7 mgKOH/g. Further, the resin (410 parts) was charged to a reaction vessel equipped with a condenser tube, a stirrer and a nitrogen inlet tube, and isophorone diisocyanate (22 parts) and ethyl acetate (500 parts) were added and reacted at 100° C. for 5 hours to thereby obtain [Pes3].

(Production of Polymerized Toner 7)

A toner was obtained in the same manner as in Example A2, except that [Pes3] was used instead of [Pes1] used in the production of an oil phase, thereby obtaining [Polymerized Toner 7].

Example A8

A toner was obtained in the same manner as in Example A3, except that [Pes3] was used instead of [Pes1] used in the production of an oil phase, thereby obtaining [Polymerized Toner 8].

Example A9

The procedure of Example A1 was repeated, except that only 1,000 parts of [Pigment-Wax Dispersion Liquid 1] were poured in a reaction vessel without using [Prepolymer 1] and [Ketimine Compound 1], mixed at 5,000 rpm for 1 minute using a TK homomixer (manufactured by Tokushu Kikai Kogyo Co. Ltd.), and then 1,200 parts of [Aqueous Phase 1] were added to the vessel, mixed at 15,000 rpm for 30 minutes to obtain [Emulsion Slurry 2]. Subsequently, [Polymerized Toner 9] was obtained in the same manner as in Example A1.

Comparative Example A1

A toner was obtained in the same manner as in Example A1, except that [Masterbatch 4] using [Pes1] was used instead of [Cpes1] of [Masterbatch 1], thereby obtaining [Polymerized Toner 10].

Comparative Example A2

A toner was obtained in the same manner as in Example A1, except that [Masterbatch 5] using [Pes2] was used instead of [Cpes1] of [Masterbatch 1], thereby obtaining [Polymerized Toner 11].

Comparative Example A3

A toner was obtained in the same manner as in Example A1, except that [Masterbatch 6] using [Pes3] was used instead of [Cpes1] of [Masterbatch 1], thereby obtaining [Polymerized Toner 12].

Comparative Example A4

A toner was obtained in the same manner as in Example A1, except that [Pes1] was used instead of [Cpes1] of [Masterbatch 1], and [Cpes1] was used instead of [Pes1] used in the production of an oil phase, thereby obtaining [Polymerized Toner 13].

Comparative Example A5

A toner was obtained in the same manner as in Example A2, except that [Cpes2] was used instead of [Pes1] used in the production of an oil phase, and [Pes1] was used instead of [Cpes2] of [Masterbatch Dispersion Liquid 2], thereby obtaining [Polymerized Toner 14]. However, it was impossible to granulate the toner.

The formulations of Masterbatches and Toners used in Examples are shown in Table 1. The formulations of Masterbatches and Toners used in Comparative Examples are shown in Table 2.

TABLE 1

| | Ex. A1 (Toner 1) | | Ex. A2 (Toner 2) | | Ex. A3 (Toner 3) | |
|---|---|---|---|---|---|---|
| | MB dispersion liquid | Oil phase | MB dispersion liquid | Oil phase | MB dispersion liquid | Oil phase |
| Binder resin | Pes1 | Pes1 | Pes1 | Pes1 | Pes1 | Pes1 |
| Pigment | PR122 | | PR122 | | PR122 | |
| Crystalline resin | Cpes1 | | Cpes2 | | Cpes3 | |

| | Ex. A4 (Toner 4) | | Ex. A5 (Toner 5) | | Ex. A6 (Toner 6) | |
|---|---|---|---|---|---|---|
| | MB dispersion liquid | Oil phase | MB dispersion liquid | Oil phase | MB dispersion liquid | Oil phase |
| Binder resin | Pes1 | Pes2 | Pes1 | Pes2 | Pes1 | Pes2 |
| Pigment | PR122 | | PR122 | | PR122 | |
| Crystalline resin | Cpes1 | | Cpes2 | | Cpes3 | |

| | Ex. A7 (Toner 7) | | Ex. A8 (Toner 8) | | Ex. A9 (Toner 9) | |
|---|---|---|---|---|---|---|
| | MB dispersion liquid | Oil phase | MB dispersion liquid | Oil phase | MB dispersion liquid | Oil phase |
| Binder resin | Pes1 | Pes3 | Pes1 | Pes3 | Pes1 | Pes1 |
| Pigment | PR122 | | PR122 | | PR122 | |
| Crystalline resin | Cpes2 | | Cpes3 | | Cpes1 | |

TABLE 2

| | Comp. Ex. A1 (Toner 10) | | Comp. Ex. A2 (Toner 11) | | Comp. Ex. A3 (Toner 12) | | Comp. Ex. A4 (Toner 13) | | Comp. Ex. A5 (Toner 14) | |
|---|---|---|---|---|---|---|---|---|---|---|
| | MB dispersion liquid | Oil phase | MB dispersion liquid | Oil phase | MB dispersion liquid | Oil phase | MB dispersion liquid | Oil phase | MB dispersion liquid | Oil phase |
| Binder resin | Pes1 | Pes1 | Pes1 | Pes1 | Pes1 | Pes1 | Pes1 | Cpes1 | Pes1 | Cpes2 |
| Pigment | PR122 | | PR122 | | PR122 | | PR122 | | PR122 | |
| Crystalline resin | Pes1 | | Pes2 | | Pes3 | | Pes1 | | Cpes2 | |

To obtain toner base particles of Examples and Comparative Examples, the following resin materials for pigment dispersion (colorant dispersion resin) were prepared, and preparation of colorant masterbatchs, preparation of a wax dispersion liquid, preparation of toner compositions, preparation of a resin fine particle emulsion, preparation of an aqueous medium phase, etc. were performed.

Aromatic nitrogen-containing compound modification and aliphatic nitrogen-containing compound modification described below mean "polyester containing an amide bond structure" of the present invention, and being "sparingly soluble" means having the "sparing solubility" defined as above.

Further, colorant masterbatches were also produced using resin materials for pigment dispersion (colorant dispersion resin).

Physical property values of each resin used in the prototypes described above, including the composition of each colorant dispersion resin are shown in Table 3. The kneading solubility of each of the resins was examined, and the compatibility between the binder resin and the colorant dispersion resin was verified in the combinations of resins used in all the Examples.

[Preparation of Colorant Masterbatch (MB)]

[Yellow Masterbatch A]

Water (100 parts), PY185 (D1155, produced by BASF) (200 parts) and Polyester A (800 parts) were mixed and stirred. The mixture was kneaded with a two-roll at 150° C. for 10 minutes, further kneaded at 100° C. for 20 minutes, cool rolled, and then pulverized by a pulverizer (manufactured by (manufactured by Hosokawa Micron K.K.) to prepare Yellow Masterbatch A.

[Yellow Masterbatch B]

Yellow Masterbatch B was prepared in the same manner as in Yellow Masterbatch A, except that Polyester A containing an ether-partial structure was changed to Polyester B containing an ether-partial structure.

[Yellow Masterbatch C]

Water (100 parts), PY185 (D1155, produced by BASF) (200 parts), PY74 (Hansa Yellow 5GXT, produced by Clariant Japan K.K.) (200 parts) and Polyester C (600 parts) were mixed and stirred. The mixture was kneaded with a two-roll at 150° C. for 10 minutes, further kneaded at 100° C. for 20 minutes, cool rolled, and then pulverized by a pulverizer (manufactured by (manufactured by Hosokawa Micron K.K.) to prepare Yellow Masterbatch C.

TABLE 3

| | Tg ° C. | Weight average molecular weight Mw | Divalent or higher polybasic acid, aromatic acid Amount (% by mass) | Dihydric or higher polyhydric alcohol (BisA-based) Amount (% by mass) | Epoxylated product Amount (% by mass) | Modified product Amount (% by mass) | Modification type | Crystallinity Density (g/cm$^3$) | Solubility to ethyl acetate |
|---|---|---|---|---|---|---|---|---|---|
| Pes1 | 64 | 9,000 | 30 to 40 | 50 to 65 | 0 | 0 | — | 1.183 | soluble |
| Pes2 | 61 | 8,000 | 30 to 40 | 50 to 65 | 0 | 0 | — | 1.209 | soluble |
| Pes3 | 72 | 10,000 | 30 to 40 | 50 to 65 | 0 | 0 | — | 1.274 | soluble |
| Cpes1 | 70 | 9,000 | 30 to 40 | 50 to 65 | 0 | 0 | — | 1.261 | sparingly soluble |
| Cpes2 | 78 | 9,000 | 30 to 40 | 50 to 65 | 0 | 0 | — | 1.402 | sparingly soluble |
| Cpes3 | 69 | 9,000 | 30 to 40 | 50 to 65 | 0 | 0 | — | 1.430 | sparingly soluble |
| Polyester A | 68 | 46,000 | 30 to 40 | 50 to 65 | 1 to 10 | 0.1 to 3 | Aromatic-based | 1.281 | sparingly soluble |
| Polyester B | 66 | 46,000 | 30 to 40 | 50 to 65 | 1 to 10 | 0.1 to 3 | Aliphatic-based | 1.251 | sparingly soluble |
| Polyester C | 65 | 25,000 | 30 to 40 | 50 to 65 | 1 to 10 | 0.1 to 3 | Aromatic-based | 1.253 | sparingly soluble |
| Polyester D | 64 | 25,000 | 30 to 40 | 50 to 65 | 1 to 10 | 0.1 to 3 | Aliphatic-based | 1.257 | sparingly soluble |
| Polyester E | 60 | 15,000 | 30 to 40 | 50 to 65 | 1 to 10 | 0.1 to 3 | Aliphatic-based | 1.257 | sparingly soluble |
| Polyester F | 59 | 10,000 | 30 to 40 | 50 to 65 | 1 to 10 | 0.1 to 3 | Aliphatic-based | 1.254 | sparingly soluble |
| Polyester G | 56 | 5,000 | 30 to 40 | 50 to 65 | 1 to 10 | 0.1 to 3 | Aliphatic-based | 1.255 | sparingly soluble |
| Polyester H | 64 | 25,000 | 30 to 40 | 70 to 80 | 1 to 10 | 0 | — | 1.234 | soluble |
| Polyester I | 52 | 36,000 | 30 to 40 | 50 to 65 | 1 to 10 | 1 to 10 | Styrene | 1.199 | soluble |

[Yellow Masterbatch D]

Yellow Masterbatch D was prepared in the same manner as in Yellow Masterbatch C, except that Polyester C containing an ether-partial structure was changed to Polyester D containing an ether-partial structure.

[Yellow Masterbatch E]

Yellow Masterbatch E was prepared in the same manner as in Yellow Masterbatch C, except that Polyester C containing an ether-partial structure was changed to Polyester E containing an ether-partial structure.

[Yellow Masterbatch F]

Yellow Masterbatch F was prepared in the same manner as in Yellow Masterbatch C, except that Polyester C containing an ether-partial structure was changed to Polyester F containing an ether-partial structure.

[Yellow Masterbatch G]

Yellow Masterbatch G was prepared in the same manner as in Yellow Masterbatch C, except that Polyester C containing an ether-partial structure was changed to Polyester G containing an ether-partial structure.

[Yellow Masterbatch H]

Yellow Masterbatch H was prepared in the same manner as in Yellow Masterbatch C, except that Polyester C containing an ether-partial structure was changed to Polyester H containing an ether-partial structure.

[Yellow Masterbatch I]

Yellow Masterbatch I was prepared in the same manner as in Yellow Masterbatch C, except that Polyester C containing an ether-partial structure was changed to Polyester I containing an ether-partial structure.

[Yellow Masterbatch J]

Yellow Masterbatch J was prepared in the same manner as in Yellow Masterbatch C, except that Polyester C containing an ether-partial structure was changed to Polyester J containing an ether-partial structure.

[Magenta Masterbatch A]

Water (100 parts), PR122 (Fastgen Red RTS, produced by DIC) (200 parts) and Polyester A (800 parts) were mixed and stirred. The mixture was kneaded with a two-roll at 150° C. for 10 minutes, further kneaded at 100° C. for 20 minutes, cool rolled, and then pulverized by a pulverizer (manufactured by (manufactured by Hosokawa Micron K.K.) to prepare Magenta Masterbatch A.

[Magenta Masterbatch B]

Magenta Masterbatch B was prepared in the same manner as in Magenta Masterbatch A, except that Polyester A containing an ether-partial structure was changed to Polyester B containing an ether-partial structure.

[Magenta Masterbatch C]

Water (100 parts), PR122 (Fastgen Red RTS, produced by DIC) (200 parts), PR122 (1022 KB, produced by DIC) (200 parts) and Polyester C (600 parts) were mixed and stirred. The mixture was kneaded with a two-roll at 150° C. for 10 minutes, further kneaded at 100° C. for 20 minutes, cool rolled, and then pulverized by a pulverizer (manufactured by (manufactured by Hosokawa Micron K.K.) to prepare Magenta Masterbatch C.

[Magenta Masterbatch D]

Magenta Masterbatch D was prepared in the same manner as in Magenta Masterbatch C, except that Polyester C containing an ether-partial structure was changed to Polyester D containing an ether-partial structure.

[Magenta Masterbatch E]

Magenta Masterbatch E was prepared in the same manner as in Magenta Masterbatch C, except that Polyester C containing an ether-partial structure was changed to Polyester E containing an ether-partial structure.

[Magenta Masterbatch F]

Magenta Masterbatch F was prepared in the same manner as in Magenta Masterbatch C, except that Polyester C containing an ether-partial structure was changed to Polyester F containing an ether-partial structure.

[Magenta Masterbatch G]

Magenta Masterbatch G was prepared in the same manner as in Magenta Masterbatch C, except that Polyester C containing an ether-partial structure was changed to Polyester G containing an ether-partial structure.

[Magenta Masterbatch H]

Magenta Masterbatch H was prepared in the same manner as in Magenta Masterbatch C, except that Polyester C containing an ether-partial structure was changed to Polyester H containing an ether-partial structure.

[Magenta Masterbatch I]

Magenta Masterbatch I was prepared in the same manner as in Magenta Masterbatch C, except that Polyester C containing an ether-partial structure was changed to Polyester I containing an ether-partial structure.

[Magenta Masterbatch J]

Magenta Masterbatch J was prepared in the same manner as in Magenta Masterbatch C, except that Polyester C containing an ether-partial structure was changed to Polyester J containing an ether-partial structure.

[Magenta Masterbatch CA]

Crystalline Magenta Masterbatch CA was prepared in the same manner as in Magenta Masterbatch A, except that CPesA having a crystalline structure was used instead of Polyester A.

[Magenta Masterbatch CB]

Crystalline Magenta Masterbatch CB was prepared in the same manner as in Magenta Masterbatch A, except that CPesB having a crystalline structure was used instead of Polyester B.

[Preparation of Wax Dispersion Liquid]

Next, a dispersion liquid having the following composition to which a resin as a binder resin and a wax were added was prepared.

The after-mentioned unmodified polyester serving as a binder resin (100 parts), paraffin wax (HPE-11) (90 parts) and a maleic acid-modified paraffin wax (P-166) (10 parts) were added to and dispersed in ethyl acetate (400 parts) and stirred for 10 minutes using a mixer having stirring blades, in the same manner as in the preparation of the colorant dispersion liquid, and further dispersed for 8 hours using a DYNO Mill.

[Preparation of Toner Composition]

(Examples B1 to B16), (Comparative Examples B1 to B6)

Toner Composition YA, Toner Composition YB

As for toner composition liquids using Yellow Masterbatch A or Yellow Masterbatch B, each Yellow Masterbatch (35 parts), Wax Dispersion Liquid (30 parts), an unmodified polyester resin (soluble type, Tg 62° C., AV 10.0, Mw 40,000, produced by DIC) (62 parts) were charged into ethyl acetate (100 parts), dissolved or dispersed using a mixer having stirring blades, and then a material solution was prepared with a bead mill (ULTRA VISCOMILL manufactured by Aimex Co., Ltd.) under the following conditions: liquid feed rate: 1 kg/hr, disc circumferential speed: 6 m/sec, 0.5 mm-zirconia bead filled at 80% by volume, and three passes. The solid content of the solution or dispersion liquid of toner materials was adjusted to 50% by mass in consideration of the productivity, and each toner composition was prepared (Toner Composition YA, Toner Composition YB).

[Toner Composition YC to Toner Composition YJ]

As for toner composition liquids using each of Yellow Masterbatch C to Yellow Masterbatch J, each Yellow Masterbatch (17.5 parts), Wax Dispersion Liquid (30 parts), an unmodified polyester resin (soluble type, Tg 62° C., AV 10.0, Mw 40,000, produced by DIC) (79.5 parts) were charged into ethyl acetate (100 parts), dissolved or dispersed using a mixer having stirring blades, and then a material solution was prepared with a bead mill (ULTRA VISCOMILL manufactured by Aimex Co., Ltd.) under the following conditions: liquid feed rate: 1 kg/hr, disc circumferential speed: 6 m/sec, 0.5 mm-zirconia bead filled at 80% by volume, and three passes. The solid content of the solution or dispersion liquid of toner materials was adjusted to 50% by mass in consideration of the productivity, and each toner composition was prepared (Toner Composition YC to Toner Composition YJ).

[Toner Composition MA, Toner Composition MB]

As for toner composition liquids using Magenta Masterbatch A or Magenta Masterbatch B, each Magenta Masterbatch (50 parts), Wax Dispersion Liquid (30 parts), an unmodified polyester resin (soluble type, Tg 62° C., AV 10.0, Mw 40,000, produced by DIC) (59 parts) were charged into ethyl acetate (100 parts), dissolved or dispersed using a mixer having stirring blades, and then a material solution was prepared with a bead mill (ULTRA VISCOMILL manufactured by Aimex Co., Ltd.) under the following conditions: liquid feed rate: 1 kg/hr, disc circumferential speed: 6 m/sec, 0.5 mm-zirconia bead filled at 80% by volume, and three passes. The solid content of the solution or dispersion liquid of toner materials was adjusted to 50% by mass in consideration of the productivity, and each toner composition was prepared (Toner Composition MA, Toner Composition MB).

[Toner Composition MC to Toner Composition MJ]

As for toner composition liquids using each Magenta Masterbatch C to Magenta Masterbatch J, each Magenta Masterbatch (17.5 parts), Wax Dispersion Liquid (30 parts), an unmodified polyester resin (soluble type, Tg 62° C., AV 10.0, Mn 5,800, Mw 40,000, produced by DIC) (79.5 parts) were charged into ethyl acetate (100 parts), dissolved or dispersed using a mixer having stirring blades, and then a material solution was prepared with a bead mill (ULTRA VISCOMILL manufactured by Aimex Co., Ltd.) under the following conditions: liquid feed rate: 1 kg/hr, disc circumferential speed: 6 m/sec, 0.5 mm-zirconia bead filled at 80% by volume, and three passes. The solid content of the solution or dispersion liquid of toner materials was adjusted to 50% by mass in consideration of the productivity, and each toner composition was prepared (Toner Composition MC to Toner Composition MJ).

[Toner Composition MK]

As for a toner composition liquid using each Magenta Masterbatch C, each Magenta Masterbatch (17.5 parts), Wax Dispersion Liquid (30 parts), a styrene-modified polyester resin (soluble type, Tg: 52° C., AV: 16.5, Mw 89,000, produced by KAO Corporation) (79.5 parts) were charged into ethyl acetate (100 parts), dissolved or dispersed using a mixer having stirring blades, and then a material solution was prepared with a bead mill (ULTRA VISCOMILL manufactured by Aimex Co., Ltd.) under the following conditions: liquid feed rate: 1 kg/hr, disc circumferential speed: 6 m/sec, 0.5 mm-zirconia bead filled at 80% by volume, and three passes. The solid content of the solution or dispersion liquid of toner materials was adjusted to 50% by mass in consideration of the productivity, and Toner Composition Mk was prepared (Toner Composition MK).

[Toner Composition ML]

Toner Composition ML was prepared in the same manner as in Composition MK, except that the modified polyester resin (soluble type, Tg 52° C., AV 16.5, Mw 89,000, produced by KAO Corporation) used in Toner Composition MK was changed to an olefin-modified polyester (soluble type, Tg 52° C., AV18.0, Mw 89,000, produced by Mitsubishi Rayon Co., Ltd).

[Preparation of Resin Fine Particle]

Into a reaction vessel equipped with a stirrer and a thermometer, water (683 parts), sodium salt of methacrylic acid ethylene oxide adduct sulfate ester (ELEMINOL RS-30, produced by Sanyo Chemical Industries, Ltd.) (11 parts), styrene (79 parts), methacrylic acid (79 parts), butyl acrylate (105 parts), divinylbenzene (13 parts) and ammonium persulfate (1 part) were charged and then stirred at 400 rpm for 15 minutes to obtain a white liquid emulsion. Then, the temperature of the reaction system was raised to 75° C. by heating and reacted for 5 hours. Further, a 1% by mass ammonium persulfate aqueous solution (30 parts) was added to the reaction system and aged at 75° C. for 5 hours to thereby obtain an aqueous dispersion liquid of a vinyl-based resin (a copolymer of styrene methacrylate-butyl acrylate-sodium salt of methacrylic acid ethylene oxide adduct sulfate ester) [Fine Particle Dispersion Liquid].

The average particle diameter of [Fine Particle Dispersion Liquid] thus obtained was measured by a LA-920 (laser diffraction/scattering type particle size distribution measurement device, manufactured by HORIBA Ltd.) and found to be 105 nm. A part of [Fine Particle Dispersion Liquid 1] was dried so that the resin parts were isolated therefrom. The resin was found to have a glass transition temperature (Tg) of 95° C., a number average molecular weight of 140,000 and a weight average molecular weight of 980,000.

[Preparation of Aqueous Medium Phase]

Ion exchanged water (306 parts), the resin fine particle dispersion liquid (60 parts), and sodium dodecylbenzene sulfonate (4 parts) were mixed and stirred so as to be uniformly dissolved to prepare an aqueous medium phase (aqueous medium).

[Preparation of Emulsion or Dispersion Liquid]

The aqueous medium (200 parts) was poured into a vessel, stirred at 8,500 rpm with a TK homomixer (manufactured by Tokushu Kikai Kogyo Co. Ltd.), Toner Composition (100 parts) prepared above was added thereto, and mixed for 10 minutes to thereby prepare an emulsion or dispersion liquid (Emulsion/Dispersion Liquid: Emulsion Slurry).

<Removal of Organic Solvent>

In a kolben equipped with a stirrer and a thermometer, the emulsion slurry (100 parts) prepared above was charged, and the solvent was removed therefrom at 30° C. for 12 hours while being stirred at a stirring circumferential speed of 20 m/min.

<Washing and Drying>

After 100 parts of the dispersion slurry was filtered under reduced pressure, 100 parts of ion exchanged water were added to the resulting filtration cake and mixed at 12,000 rpm for 10 minutes using a TK homomixer (manufactured by Tokushu Kikai Kogyo Co. Ltd.), followed by a filtration treatment. Into the filtration cake thus obtained, 300 parts of ion exchanged water were added, and mixed at 12,000 rpm for 10 minutes, followed by a filtration treatment. This treatment was repeated two times. A 10% by mass sodium hydroxide aqueous solution (20 parts) was added to the filtration cake, mixed at 12,000 rpm for 30 minutes using a TK homomixer, and then filtered under reduced pressure.

Into the filtration cake prepared as above, 300 parts of ion exchanged water were added, and mixed at 12,000 rpm for 10 minutes using a TK homomixer, followed by a filtration treatment. Into the thus obtained filtration cake, 300 parts of ion exchanged water were added, and mixed at 12,000 rpm for 10 minutes using a TK homomixer, followed by a filtration treatment. The above process was repeated two times. Further, into the filtration cake prepared, 20 parts of a 10% by mass hydrochloric acid were added, and mixed at 12,000 rpm for 10 minutes using a TK homomixer and then filtered. Into the filtration cake thus prepared, 300 parts of ion exchanged water were added, and mixed at 12,000 rpm for 10 minutes using a TK homomixer, followed by a filtration treatment. This treatment was repeated two times, and thereby a final filtration cake was obtained.

The thus obtained final filtration cake was dried with a circular air-drier at 45° C. for 48 hours and sieved with a mesh with openings of 75 μm to thereby obtain toner base particles (Yellow Toner Bases YA to YJ, Magenta Toner Bases MA to ML).

More specifically, the toner base particles produced above correspond to each of the following Examples and Comparative Examples.

(Example B1: Yellow Toner Base YA), (Example B2: Yellow Toner Base YB), (Example B3: Yellow Toner Base YC), (Example B4: Yellow Toner Base YD), (Example B5: Yellow Toner Base YE), (Example B6: Yellow Toner Base YF), (Example B7: Yellow Toner Base YG), (Comparative Example B1: Yellow Toner Base YH), (Comparative Example B2: Yellow Toner Base YI), (Example B8: Magenta Toner Base MA), (Example B9: Magenta Toner Base MB), (Example B10: Magenta Toner Base MC), (Example B11: Magenta Toner Base MD), (Example B12: Magenta Toner Base ME), (Example B13: Magenta Toner Base MF), (Example B14: Magenta Toner Base MG), (Comparative Example B4: Magenta Toner Base MH), (Comparative Example B5: Magenta Toner Base MI), (Example B15: Magenta Toner Base MK), and (Example B16: Magenta Toner Base ML)

Example B17

Yellow Toner Base YE2

<Synthesis of Urea-Modified Polyester>

Into a reaction vessel equipped with a thermometer, a stirrer, a condenser, and a nitrogen inlet tube, bisphenol A ethylene oxide (2 mol) adduct (682 parts), bisphenol A propylene oxide (2 mol) adduct (81 parts), terephthalic acid (283 parts), trimellitic anhydride (22 parts) and dibutyltin oxide (2 parts) were added, and reacted at 230° C. for 8 hours. Next, the reaction product was further reacted under reduced pressure of 10 mmHg to 15 mmHg for 5 hours to thereby synthesize an intermediate polyester.

The thus obtained intermediate polyester was found to have a number average molecular weight (Mn) of 2,100, a mass average molecular weigh of 9,600, a glass transition temperature (Tg) of 55° C., an acid value of 0.5 mgKOH/g and a hydroxyl value of 49 mg KOH/g.

Next, into a reaction vessel equipped with a thermometer, a stirrer, a condenser, and a nitrogen inlet tube, the intermediate polyester (411 parts), isophorone diisocyanate (89 parts) and ethyl acetate (500 parts) were charged and reacted at 100° C. for 5 hours to thereby synthesize a urea-modified polyester (polymer having a functional group reactive with the active hydrogen group).

The thus obtained urea-modified polyester has a free-isocyanate content of 1.60% by mass, and the solid content of the urea-modified polyester (after left standing at 150° C. for 45 minutes) was 50% by mass.

<Synthesis of Ketimine (Active Hydrogen-Containing Compound Described Above)>

Into a reaction vessel equipped with a stirrer and a thermometer, isophorone diamine (30 parts) and methylethylketone (70 parts) were charged and reacted at 50° C. for 5 hours to thereby synthesize a ketimine compound (the active hydrogen group-containing compound).

The thus obtained ketimine compound (the active hydrogen group-containing compound) was found to have an amine value of 423.

<Preparation of Solution or Dispersion Liquid of Toner Material>

Into a beaker, the urea-modified polyester (10 parts), an unmodified polyester (69.5 parts) (soluble type, SREX-005L, produced by Sanyo Chemical Co., Ltd.), Yellow Masterbatch E (17.5 parts), Wax Dispersion (30 parts) and ethyl acetate (100 parts) were charged, and dissolved with stirring. A material solution of the reaction product was prepared using a bead mill (ULTRA VISCOMILL manufactured by Aimex Co., Ltd.) under the following conditions: liquid feed rate: 1 kg/hr, disc circumferential speed: 6 m/sec, 0.5 mm-zirconia bead filled at 80% by volume, and three passes. Then, the ketimine (2.7 parts) was added to the material solution and dissolved therein to prepare a toner composition liquid. The solid content of the solution or dispersion liquid was adjusted to 50% by mass in consideration of the productivity.

<Preparation of Emulsion or Dispersion Liquid>

The aqueous medium (200 parts) was poured into a vessel, stirred at 8,500 rpm with a TK homomixer (manufactured by Tokushu Kikai Kogyo Co. Ltd.), the solution or dispersion liquid of toner materials (100 parts) prepared above was added thereto, and mixed for 10 minutes to thereby prepare an emulsion or dispersion liquid (Emulsion Slurry).

<Removal of Organic Solvent>

In a kolben equipped with a stirrer and a thermometer, the emulsion slurry (100 parts) prepared above was charged, and the solvent was removed therefrom at 30° C. for 12 hours while being stirred at a stirring circumferential speed of 20 m/min.

<Washing and Drying>

After 100 parts of the dispersion slurry was filtered under reduced pressure, 100 parts of ion exchanged water were added to the resulting filtration cake and mixed at 12,000 rpm for 10 minutes using a TK homomixer (manufactured by Tokushu Kikai Kogyo Co. Ltd.), followed by a filtration treatment. Into the filtration cake thus prepared, 300 parts of ion exchanged water were added, and mixed at 12,000 rpm for 10 minutes, followed by a filtration treatment. This treatment was repeated two times. A 10% by mass sodium hydroxide aqueous solution (20 parts) was added to the filtration cake and mixed at 12,000 rpm for 30 minutes using a TK homomixer, and then filtered under reduced pressure. Into the filtration cake prepared as above, 300 parts of ion exchanged water were added, and mixed at 12,000 rpm for 10 minutes using a TK homomixer, followed by a filtration treatment. This treatment was repeated two times. Further, into the filtration cake prepared, 20 parts of a 10% by mass sodium hydroxide aqueous solution were added, mixed at 12,000 rpm for 10 minutes using a TK homomixer and then filtered. Into the filtration cake thus prepared, 300 parts of ion exchanged water were added, and mixed at 12,000 rpm for 10 minutes using a TK homomixer, followed by a filtration treatment. This treatment was repeated two times, and thereby a final filtration cake was obtained.

The thus obtained final filtration cake was dried with a circular air-drier at 45° C. for 48 hours and sieved with a mesh with openings of 75 μm to thereby obtain toner base particles (Yellow Toner Base YE2).

Example B18

Magenta Toner Base ME2

<Preparation of Solution or Dispersion Liquid of Toner Material>

Into a beaker, the urea-modified polyester (5 parts), a styrene-modified polyester (64.5 parts) (soluble type, Tg: 52° C., AV 16.5, Mw: 90,000, produced by KAO Corporation), Magenta Masterbatch E (17.5 parts), Wax Dispersion (30 parts) and ethyl acetate (100 parts) were charged, and dissolved with stirring. A material solution of the reaction product was prepared using a bead mill (ULTRA VISCOMILL manufactured by Aimex Co., Ltd.) under the following conditions: liquid feed rate: 1 kg/hr, disc circumferential speed: 6 m/sec, 0.5 mm-zirconia bead filled at 80% by volume, and three passes. Then, the ketimine (2.7 parts) was added to the material solution and dissolved therein to prepare a toner composition liquid. The solid content of the solution or dispersion liquid was adjusted to 50% by mass in consideration of the productivity.

The Preparation of Emulsion or Dispersion Liquid, Removal of Organic Solvent, Washing and Drying for Yellow Toner Base Particle YE2 were repeated except for Preparation of Solution or Dispersion Liquid of Toner Material, thereby obtaining a toner base particle (Magenta Toner Base ME2).

Example B19

Yellow Toner Base YE3

<Preparation of Crystalline Polyester Dispersion Liquid>

A crystalline polyester (Tm: 70° C., produced by KAO Corporation) (20 parts) and ethyl acetate (80 parts) were mixed. Then, the mixture was dispersed by a ball mill (5 mm-zirconia bead) (ULTRA VISCOMILL manufactured by Aimex Co., Ltd.) and further finely dispersed by a star mill (manufactured by Ashizawa Co. Ltd.) to thereby produce a crystalline dispersion liquid having an average particle diameter of 0.7 μm.

<Preparation of Solution or Dispersion Liquid of Toner Material>

Into a beaker, the urea-modified polyester (10 parts), an unmodified polyester (64.5 parts) (soluble type, SREX-005L, produced by Sanyo Chemical Co., Ltd.), Yellow Masterbatch E (17.5 parts), Wax Dispersion (30 parts), the crystalline polyester dispersion liquid (25 parts), and ethyl acetate (60 parts) were charged, and dissolved with stirring. A material solution of the reaction product was prepared using a bead mill (ULTRA VISCOMILL manufactured by Aimex Co., Ltd.) under the following conditions: liquid feed rate: 1 kg/hr, disc circumferential speed: 6 m/sec, 0.5 mm-zirconia bead filled at 80% by volume, and three passes. Then, the ketimine (2.7 parts) was added to the material solution and dissolved therein to prepare a toner composition liquid. The solid content of the solution or dispersion liquid was adjusted to 50% by mass in consideration of the productivity.

[Preparation of Emulsion or Dispersion Liquid]

The aqueous medium phase (200 parts) was poured into a vessel, stirred at 8,500 rpm with a TK homomixer (manufactured by Tokushu Kikai Kogyo Co. Ltd.), the solution or dispersion liquid of toner material (100 parts) prepared above was added thereto, and mixed for 10 minutes to thereby prepare an emulsion or dispersion liquid (Emulsion Slurry).

<Removal of Organic Solvent>

In a kolben equipped with a stirrer and a thermometer, the emulsion slurry (100 parts) prepared above was charged, and the solvent was removed therefrom at 30° C. for 12 hours while being stirred at a stirring circumferential speed of 20 m/min.

<Washing and Drying>

After 100 parts of the dispersion slurry was filtered under reduced pressure, 100 parts of ion exchanged water were added to the resulting filtration cake and mixed at 12,000 rpm for 10 minutes using a TK homomixer (manufactured by Tokushu Kikai Kogyo Co. Ltd.), followed by a filtration treatment. Into the filtration cake thus prepared, 300 parts of ion exchanged water were added, and mixed at 12,000 rpm for 10 minutes, followed by a filtration treatment. This treatment was repeated two times. A 10% by mass sodium hydroxide aqueous solution (20 parts) was added to the filtration cake and mixed at 12,000 rpm for 30 minutes using a TK homomixer, and then filtered under reduced pressure. Into the filtration cake prepared as above, 300 parts of ion exchanged water were added, and mixed at 12,000 rpm for 10 minutes using a TK homomixer, followed by a filtration treatment. This treatment was repeated two times. Further, into the filtration cake prepared, 20 parts of a 10% by mass hydrochloric acid were added, mixed at 12,000 rpm for 10 minutes using a TK homomixer and then filtered. Into the filtration cake thus prepared, 300 parts of ion exchanged water were added, and mixed at 12,000 rpm for 10 minutes using a TK homomixer, followed by a filtration treatment. This treatment was repeated two times, and thereby a final filtration cake was obtained.

The thus obtained final filtration cake was dried with a circular air-drier at 45° C. for 48 hours and sieved with a mesh with openings of 75 μm to thereby obtain toner base particles (Yellow Toner Base YE3).

Example B20

Magenta Toner Base ME3

A toner base particle (Magenta Toner Base ME3) was obtained in the same manner as in Example B19, except that Yellow Masterbatch E was changed to Magenta Masterbatch E.

Each of the resulting toner base particles (abbreviated as "base particle(s)) of Examples A1 to A9, Examples B1 to B20 and Comparative Examples A1 to A5 and Comparative Examples B1 to B4 was observed through a TEM for its pigment dispersion state and pigment particle diameter.

The evaluation results of Examples A1 to A9, Examples B1 to B20 and Comparative Examples A1 to A5 and Comparative Examples B1 to B4 are shown in Tables 4A and 4B.

TABLE 4A

| | Pigment dispersion state | Particle diameter of dispersed pigment | Comprehensive evaluation | Masterbatch | | Pigment |
|---|---|---|---|---|---|---|
| Ex. A1 | A | B | B | Masterbatch 1 | Aromatic: 9000 | PR122 |
| Ex. A2 | A | B | B | Masterbatch 2 | Aromatic: 9000 | PR122 |
| Ex. A3 | A | A | A | Masterbatch 3 | Aromatic: 9000 | PR122 |
| Ex. A4 | A | B | B | Masterbatch 1 | Aromatic: 9000 | PR122 |
| Ex. A5 | A | B | B | Masterbatch 2 | Aromatic: 9000 | PR122 |
| Ex. A6 | A | A | A | Masterbatch 3 | Aromatic: 9000 | PR122 |
| Ex. A7 | A | B | B | Masterbatch 2 | Aromatic: 9000 | PR122 |
| Ex. A8 | A | A | A | Masterbatch 3 | Aromatic: 9000 | PR122 |
| Ex. A9 | A | B | B | Masterbatch 1 | Aromatic: 9000 | PR122 |
| Comp. Ex. A1 | C | C | D | Masterbatch 4 | Aromatic: 9000 | PR122 |
| Comp. Ex. A2 | C | C | D | Masterbatch 5 | Aromatic: 8000 | PR122 |
| Comp. Ex. A3 | C | C | D | Masterbatch 6 | Aromatic: 10000 | PR122 |
| Comp. Ex. A4 | C | C | D | Masterbatch 4 | Aromatic: 9000 | PR122 |
| Comp. Ex. A5 | Impossible to granulate | | | Masterbatch 5 | Aromatic: 8000 | PR122 |

TABLE 4B

| | Pigment dispersion state | Particle diameter of dispersed pigment | Comprehensive evaluation | | Masterbatch | Pigment |
|---|---|---|---|---|---|---|
| Ex. B1 | A | B | B | YA | Aromatic-based: 46000 | PY185 |
| Ex. B2 | A | B | B | YB | Aliphatic: 46000 | PY185 |
| Ex. B3 | A | A | A | YC | Aromatic-based: 25000 | PY185/PY74 |
| Ex. B4 | A | A | A | YD | Aliphatic: 25000 | PY185/PY74 |
| Ex. B5 | A | A | A | YE | Aliphatic: 15000 | PY185/PY74 |
| Ex. B6 | A | A | A | YF | Aliphatic: 10000 | PY185/PY74 |
| Ex. B7 | B | A | B | YG | Aliphatic: 5000 | PY185/PY74 |
| Ex. B8 | A | B | B | MA | Aromatic-based: 46000 | PR122 |
| Ex. B9 | A | B | B | MB | Aliphatic: 46000 | PR122 |
| Ex. B10 | A | A | A | MC | Aromatic-based: 25000 | PR122/PR269 |
| Ex. B11 | A | A | A | MD | Aliphatic: 25000 | PR122/PR269 |
| Ex. B12 | A | A | A | ME | Aliphatic: 15000 | PR122/PR269 |
| Ex. B13 | A | A | A | MF | Aliphatic: 10000 | PR122/PR269 |
| Ex. B14 | B | A | B | MG | Aliphatic: 5000 | PR122/PR269 |
| Ex. B15 | A | A | A | MK | Aliphatic: 15000 | PR122/PR269 |
| Ex. B16 | A | A | A | ML | Aliphatic: 15000 | PR122/PR269 |
| Ex. B17 | A | A | A | YE2 | Aliphatic: 15000 | PY185/PY74 |
| Ex. B18 | A | A | A | ME2 | Aliphatic: 15000 | PR122/PR269 |
| Ex. B19 | A | A | A | YE3 | Aliphatic: 15000 | PY185/PY74 |
| Ex. B20 | A | A | A | ME3 | Aliphatic: 15000 | PR122/PR269 |
| Comp. Ex. B1 | C | C | D | YH | Unmodified: 25000 | PY185/PY74 |
| Comp. Ex. B2 | C | C | D | YI | Styrene-modified: 36000 | PY185/PY74 |
| Comp. Ex. B3 | C | C | D | MH | Unmodified: 25000 | PR122/PR269 |
| Comp. Ex. B4 | C | C | D | MI | Styrene-modified: 36000 | PR122/PR269 |

Figure 2A:
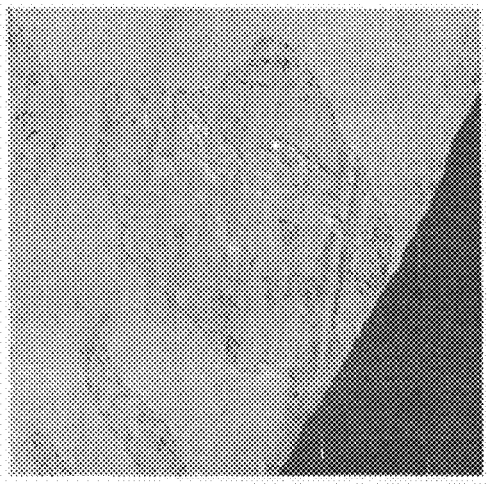
FIG. 2A is a TEM observation image illustrating the pigment-dispersed state of toner base particle (YH) produced in Comparative Examples.
Figure 2B:
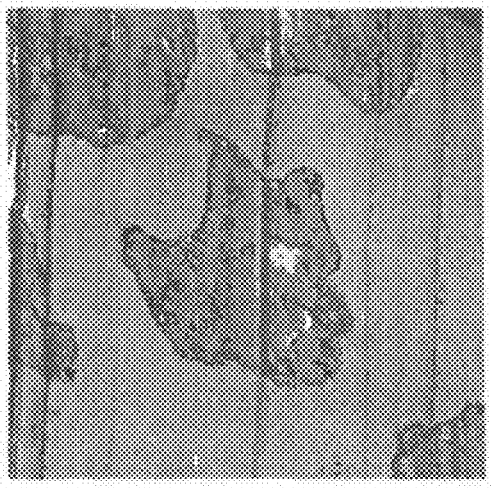
FIG. 2B is a TEM observation image illustrating the pigment-dispersed state of toner base particle (MH) produced in Comparative Examples.

Note that the pigment dispersion state of typical base particles (YA), (YE), (YG), (MA), (ME), and (MG) produced in Examples are illustrated as TEM observation images in FIG. 1; and the pigment dispersion state of typical base particles (YH) and (MH) produced in Comparative Examples are illustrated as TEM observation images in FIG. 2.

As evaluation criteria shown in Tables 4A and 4B, in the case where the pigment dispersed state in toner was excellent (pigment was uniformly dispersed), the toner base particle was evaluated as "A"; in the case where the pigment was uniformly dispersed but partially localized on surfaces of the toner, the toner base particle was evaluated as "B"; and in the case where all toner base particles are localized on surfaces of the toner, the toner base particle was evaluated as "C". As the pigment particle diameter, a pigment having particle diameters of 150 nm or smaller was evaluated as "A"; a pigment having particle diameters greater than 150 nm and 250 nm or smaller was evaluated as "B"; a pigment having particle diameters greater than 250 nm was evaluated as "C".

Also, as the comprehensive evaluation, in the case where both the pigment dispersion state and the pigment particle diameter were evaluated as A, it was graded as "A"; in the case where one of the pigment dispersion state and the pigment particle diameter was evaluated as A or B and the other item was evaluated as B, it was graded as "B"; one of these items was evaluated as "A" or "B" and the other item was evaluated as "C", it was graded as "C"; and both of these items were evaluated as "C", it was graded as "D".

Examples A10 to A18, Comparative Examples A6 to A10, Examples B20 to Examples B40, and Comparative Examples B5 to B8

With respect to 100 parts by mass of each of the toner base particles obtained in Examples A1 to A9, Examples B1 to B20 and Comparative Examples A1 to A5 and Comparative Examples B1 to B4, H1303 (hydrophobic silica) (1.5 parts by mass), and MA150AI (hydrophobic titania) (0.8 parts by mass) were mixed using a HENSCHEL MIXER, to obtain a toner having each base particles. Note that the additives were mixed in toner base particles for imparting the flowability and controlling the charging properties.

Each of the toners obtained above was mixed with the following carrier to produce a developer.

[Production of Carrier]

Spherical-shaped ferrite particles having a volume average particle diameter of 35 μm (as a core material) were coated with a mixture (as a coating material) of a silicone resin and a melamine resin, and thereby a carrier was produced.

[Production of Developer]

Each of the toners (5 parts) and the carrier (95 parts) were mixed by a ball mill to produce a two-component developer.

<Evaluation of Heat Resistant Storage Stability>

The toners produced in Examples A1 to A9, Comparative Examples A1 to A5 were also measured for their heat resistant storage stability. These toners were stored in a commercially available drier to thereby measure the heat resistant storage stability. Specifically, the toner (10 g) was charged to a 30 mL-glass vial, the glass vial itself was left standing without providing a cap for 24 hours in a drier (manufactured by Yamato Kagaku K.K.) with the temperature thereof being maintained at 50° C. and placed in a laboratory with the temperature and humidity being controlled at 25° C./50% RH and placed in a laboratory. Thereafter, the sample was transferred onto a mesh with openings of 75 μm, a vibration was applied thereto, and whether or not any aggregates of 1 mm or greater in size were present on the mesh was visually observed. In the case where no toner aggregate was recognized, it was graded as "A": in the case where toner aggregates less than 10 in number were found, it was graded as "B"; and in the case where toner aggregates 10 or more in number were found, it was graded as "C".

<Evaluation of Charging Stability>

Each of the two-component developers was evaluated for its charging stability by a tandem type color image forming apparatus ("IMAGIO NEO C350", manufactured by Ricoh Company Ltd.), in which a silicone oil-coating mechanism had been removed from the fixing unit so as to be remodeled in an oil-less fixing system, using a device with the temperature and the linear velocity were tuned to be controllable, and paper "Paper 6000" (produced by Ricoh Company Ltd.).

Note that the tandem type color image forming apparatus is capable of continuously printing A4-size paper at 35 sheets/min. The linear velocity of the fixing roller was set to 125 mm/s.

Each of the developers was loaded to individual developing units in the image forming apparatus. Using an image occupation rate of 5%, a 10,000-sheet running operation was performed to evaluate the printed image. Note that during the running operation, the process control was carrier out for only a toner concentration. Since a toner with unstable charging properties causes a considerable variation in image density, the charging properties thereof can be determined by the "variation in image density".

[Variation in image density]: An ID of solid patches, i.e., an average ID of solid patch portions of the first print sheet to the $10^{th}$ print sheet and an average ID of solid patch portions for every 1,000 print sheets, like an average ID of solid patch portions of from the $1{,}001^{st}$ print sheet to the $1{,}010^{th}$ print sheet, an average ID of solid patch portions of from the $2{,}001^{st}$ print sheet to the $2{,}010^{th}$ sheet, were measured. Variation ID ±0.1 or smaller was graded as "A", Variation ID greater than ±0.1 and ±0.2 or smaller was evaluated as "B"; and Variation ID greater than ±0.2 was evaluated as "C".

<Evaluation of Color Reproducibility (Color Saturation c*)>

The toners produced in Examples A1 to A9, and Comparative Examples A1 to A5 were also evaluated for their color saturation of images.

A toner sample was produced with a toner adhesion amount of 0.4 mg/cm$^2$ as an image formed in a rectangular of 3 cm×5 cm on A4 size paper sheet (T6000 70W T, produced by Ricoh Company Ltd.) at a position 3 cm away from the edge of the paper surface. The toner image was fixed on the paper sheet at a leaner velocity of 280 mm/sec while the temperature of the fixing member was constantly controlled to be 180° C. next, the image was evaluated with Status A mode of L*a*b* chromaticity by an X-Rite (manufactured by X-Rite). Specifically, the color saturation of c*(a square root of a sum of $(a^*+b^*)^2$) was determined, and the result was evaluated as the color reproducibility of image.

The evaluation results determined as above are shown in Tables 5A and 5B below.

TABLE 5A

| | ID at initial stage | Color saturation c* | Variation in image density | Heat resistant storage stability | Masterbatch | | Pigment |
|---|---|---|---|---|---|---|---|
| Ex. A10 | 1.41 | 63 | B | A | Masterbatch 1 | Aromatic-based: 9000 | PR122 |
| Ex. A11 | 1.45 | 66 | A | A | Masterbatch 2 | Aromatic-based: 9000 | PR122 |
| Ex. A12 | 1.51 | 66 | A | B | Masterbatch 3 | Aromatic-based: 9000 | PR122 |
| Ex. A13 | 1.47 | 65 | A | A | Masterbatch 1 | Aromatic-based: 9000 | PR122 |
| Ex. A14 | 1.41 | 62 | A | B | Masterbatch 2 | Aromatic-based: 9000 | PR122 |
| Ex. A15 | 1.57 | 67 | A | A | Masterbatch 3 | Aromatic-based: 9000 | PR122 |
| Ex. A16 | 1.52 | 66 | A | B | Masterbatch 2 | Aromatic-based: 9000 | PR122 |
| Ex. A17 | 1.59 | 64 | A | B | Masterbatch 3 | Aromatic-based: 9000 | PR122 |
| Ex. A18 | 1.64 | 70 | B | B | Masterbatch 1 | Aromatic-based: 9000 | PR122 |
| Comp. Ex. A6 | 1.33 | 51 | C | A | Masterbatch 4 | Aromatic-based: 9000 | PR122 |
| Comp. Ex. A7 | 1.31 | 52 | C | A | Masterbatch 5 | Aromatic-based: 8000 | PR122 |
| Comp. Ex. A8 | 1.32 | 51 | C | A | Masterbatch 6 | Aromatic-based: 10000 | PR122 |
| Comp. Ex. A9 | 1.32 | 61 | C | C | Masterbatch 4 | Aromatic-based: 9000 | PR122 |
| Comp. Ex. A10 | | Impossible to granulate | | | Masterbatch 5 | Aromatic-based: 8000 | PR122 |

TABLE 5B

| | ID at initial stage | Color saturation c* | Variation in image density | Heat resistant storage stability | | Masterbatch | Pigment |
|---|---|---|---|---|---|---|---|
| Ex. B21 | 1.32 | — | A | — | YA | Aromatic-based: 46000 | PY185 |
| Ex. B22 | 1.34 | — | A | — | YB | Aliphatic-based: 46000 | PY185 |
| Ex. B23 | 1.40 | — | A | — | YC | Aromatic-based: 25000 | PY185/PY74 |
| Ex. B24 | 1.42 | — | A | — | YD | Aliphatic-based: 25000 | PY185/PY74 |

TABLE 5B-continued

| | ID at initial stage | Color saturation c* | Variation in image density | Heat resistant storage stability | | Masterbatch | Pigment |
|---|---|---|---|---|---|---|---|
| Ex. B25 | 1.51 | — | A | — | YE | Aliphatic-based: 15000 | PY185/PY74 |
| Ex. B26 | 1.50 | — | A | — | YF | Aliphatic-based: 10000 | PY185/PY74 |
| Ex. B27 | 1.51 | — | B | — | YG | Aliphatic-based: 5000 | PY185/PY74 |
| Ex. B28 | 1.36 | — | A | — | MA | Aromatic-based: 46000 | PR122 |
| Ex. B29 | 1.38 | — | A | — | MB | Aliphatic-based: 46000 | PR122 |
| Ex. B30 | 1.51 | — | A | — | MC | Aromatic-based: 25000 | PR122/PR269 |
| Ex. B31 | 1.52 | — | A | — | MD | Aliphatic-based: 25000 | PR122/PR269 |
| Ex. B32 | 1.58 | — | A | — | ME | Aliphatic-based: 15000 | PR122/PR269 |
| Ex. B33 | 1.59 | — | A | — | MF | Aliphatic-based: 10000 | PR122/PR269 |
| Ex. B34 | 1.61 | — | B | — | MG | Aliphatic-based: 5000 | PR122/PR269 |
| Ex. B35 | 1.59 | — | A | — | MK | Aliphatic-based: 15000 | PR122/PR269 |
| Ex. B36 | 1.58 | — | A | — | ML | Aliphatic-based: 15000 | PR122/PR269 |
| Ex. B37 | 1.52 | — | A | — | YE2 | Aliphatic-based: 15000 | PY185/PY74 |
| Ex. B38 | 1.59 | — | A | — | ME2 | Aliphatic-based: 15000 | PR122/PR269 |
| Ex. B39 | 1.54 | — | A | — | YE3 | Aliphatic-based: 15000 | PY185/PY74 |
| Ex. B40 | 1.62 | — | A | — | ME3 | Aliphatic-based: 15000 | PR122/PR269 |
| Comp. Ex. B5 | 1.34 | — | C | — | YH | Unmodified: 25000 | PY185/PY74 |
| Comp. Ex. B6 | 1.29 | — | C | — | YI | Styrene-modified: 36000 | PY185/PY74 |
| Comp. Ex. B7 | 1.34 | — | C | — | MH | Unmodified: 25000 | PR122/PR269 |
| Comp. Ex. B8 | 1.32 | — | C | — | MI | Styrene-modified: 36000 | PR122/PR269 |

Next, each of the toners produced in Example B25 (Yellow Toner YE), Example B32 (Magenta Toner ME), Example B37 (Yellow Toner YE2), Example B38 (Magenta Toner ME2), Example B39 (Yellow Toner YE3), and Example B40 (Magenta Toner ME3) was used, and evaluated for the fixability.

Each of the toners was evaluated for fixability (minimum fixing temperature, hot offset occurrence temperature and fixing temperature), by a tandem type color image forming apparatus ("IMAGIO NEO C350", manufactured by Ricoh Company Ltd.), in which a silicone oil-coating mechanism had been removed from the fixing unit so as to be remodeled in an oil-less fixing system, using a device with the temperature and the linear velocity were tuned to be controllable, and paper "Paper 6000" (produced by Ricoh Company Ltd.). Note that the tandem type color image forming apparatus is capable of continuously printing A4-size paper at 35 sheets/min. At this time, the evaluation was carried out after the linear velocity of the fixing roller was set to 125 mm/s, and while varying the fixing temperature.

<Evaluation: Comparison of Fixing Temperature Width>

Using the tandem type color electrophotographic device, each monochrome solid image (in yellow and magenta) was formed on regular paper so that each monochrome color toner in an amount of 0.85±0.3 mg/cm$^2$ was developed. The obtained images were fixed for evaluation while varying the temperature of the heating roller, and a fixing roll temperature at which the residual ratio of image density after the fixed image was rubbed with a specialized cloth pat was 70% or higher was determined as the minimum fixing temperature and a fixing temperature (offset occurrence temperature) causing hot offset. The results are shown in Table 6.

TABLE 6

| Toner | Minimum fixing temperature | Hot offset occurrence temperature | Fixing temperature width |
|---|---|---|---|
| Yellow Toner YE of Ex. B25 | 130° C. | 180° C. | 50° C. |
| Magenta Toner ME of Ex. B32 | 130° C. | 180° C. | 50° C. |
| Yellow Toner YE2 of Ex. B37 | 130° C. | 200° C. | 70° C. |
| Magenta Toner ME2 of Ex. B38 | 130° C. | 200° C. | 70° C. |

TABLE 6-continued

| Toner | Minimum fixing temperature | Hot offset occurrence temperature | Fixing temperature width |
|---|---|---|---|
| Yellow Toner YE3 of Ex. B39 | 120° C. | 200° C. | 80° C. |
| Magenta Toner ME3 of Ex. B40 | 120° C. | 200° C. | 80° C. |

That is, the toner of the present invention includes base particles formed by emulsifying or dispersing, in an aqueous medium, a toner composition liquid which is obtained by dissolving or dispersing, in an organic solvent, at least a binder resin soluble in the organic solvent and a colorant masterbatch containing a colorant and a colorant dispersion resin. Since the colorant masterbatch is produced by melt-kneading the organic pigment-containing colorant and a polyester (colorant dispersion resin) which is sparingly soluble and has a specific weight average molecular weight (Mw), the dispersibility of the colorant is excellent, and excellent chargeability and color properties, and excellent permeability to OHP can be exhibited. Also, properties thereof such as low temperature fixability, hot offset resistance, heat resistant storage stability can also be excellently exhibited. Note that the colorant dispersion resin is sparingly soluble in organic solvents at a temperature of 50° C. or lower when used in preparation of Toner Composition and formation of base particles, and the glass transition temperature (Tg) thereof is preferably 50° C. to 100° C.

When as a binder resin, a resin obtained by reactivity of a resin precursor containing an active hydrogen-containing compound and a polymer (particularly, a polyester having a functional group reactive with an active hydrogen group) having a functional group reactive with the active hydrogen group of the active hydrogen-containing compound is used, a toner further excellent in hot offset resistance and a developer containing the toner can be provided.

The present invention can provide an image forming toner, an image forming developer and an image forming method for visualizing a latent electrostatic image on an image bearing member (photoconductor) in an electrophotographic apparatus, an electrostatic recording apparatuses, and can form high-quality images in which the occurrence of nonuniform density is suppressed even when continuously used.

What is claimed is:

1. A toner comprising:

base particles formed by emulsifying or dispersing, in an aqueous medium, a toner composition liquid which is obtained by dissolving or dispersing, in an organic solvent, at least a binder resin soluble in the organic solvent and a colorant masterbatch containing a colorant and a colorant dispersion resin having a weight average molecular weight (Mw) of 9,000 to 50,000, wherein the colorant contains an organic pigment selected from the group consisting of C.I. Pigment Red 269, C.I. Pigment Red 238, C.I. Pigment Red 146, C.I. Pigment Red 185, C.I.Pigment Yellow 93, C.I. Pigment Yellow 128, C.I. Pigment Yellow 180, C.I. Pigment Yellow 74, and C.I. Pigment Yellow 185, wherein the colorant dispersion resin is a resin having sparing solubility defined below:

where the "sparing solubility" means that when 4 parts by mass of the colorant dispersion resin are added to and mixed with 10 parts by mass of the organic solvent, the mixture becomes white turbid at 25° C. or becomes a transparent solution once at 25° C. and then becomes white turbid within 12 hours, wherein the colorant dispersion resin is a polyester resin containing an amide bond structure, and wherein the colorant dispersion resin has a higher density than the binder resin.

2. The toner according to claim 1, wherein the colorant dispersion resin contains a crystalline resin obtained by crystallization of the binder resin.

3. The toner according to claim 1, wherein the colorant masterbatch is obtained by melt-kneading an organic pigment-containing colorant and the colorant dispersion resin.

4. The toner according to claim 1, wherein the binder resin has compatibility with the colorant dispersion resin when kneaded with the colorant dispersion resin.

5. The toner according to claim 1, wherein the toner composition liquid contains an active hydrogen group-containing compound and a resin precursor containing a polymer having a functional group reactive with the active hydrogen group of the active hydrogen group-containing compound, and the binder resin is obtained by a reaction of the resin precursor.

6. The toner according to claim 5, wherein the polymer having the functional group reactive with the active hydrogen group is a polyester having the functional group reactive with the active hydrogen group.

7. The toner according to claim 1, wherein the toner composition liquid contains an unmodified polyester (A) together with a polyester (B) having a functional group reactive with an active hydrogen group, and a mass ratio of the polyester (B) to the unmodified polyester (A) is 1/19 to 3/1.

8. The toner according to claim 1, wherein the binder resin contains one of a styrene-modified polyester and an olefin-modified polyester.

9. The toner according to claim 1, wherein the toner composition liquid further comprises a crystalline polyester insoluble in the organic solvent.

10. The toner according to claim 9, wherein the melting point of the crystalline polyester corresponding to a peak endothermic temperature measured by differential scanning calorimetry (DSC) is 60° C. to 110° C.

11. The toner according to claim 1, wherein the polyester resin has a weight average molecular weight (Mw) of 15,000 to 50,000.

12. The toner according to claim 1, wherein the polyester resin has a glass transition temperature (Tg) of 64° C. to 68° C.

13. The toner according to claim 1, wherein the polyester resin is an epoxy-modified polyester resin.

14. The toner according to claim 1, wherein the colorant dispersion resin is present in an amount of from 0.01 to less than 3.0% by mass, relative to the total amount of toner.

15. The toner according to claim 1, wherein the colorant dispersion resin is present in an amount of from 0.01 to 1.0% by mass, relative to the total amount of toner.

16. The toner according to claim 1, wherein the colorant dispersion resin has a density of from 1.25 g/cm$^3$ to less than 1.45 g/cm$^3$.

17. A developer comprising:

a toner, and a carrier, wherein the toner comprises base particles formed by emulsifying or dispersing, in an aqueous medium, a toner composition liquid which is obtained by dissolving or dispersing, in an organic solvent, at least a binder resin soluble in the organic solvent and a colorant masterbatch containing a colorant and a colorant dispersion resin having a weight average molecular weight (Mw) of 9,000 to 50,000, wherein the colorant contains an organic pigment selected from the group consisting of C.I. Pigment Red 269, C.I. Pigment Red 238, C.I. Pigment Red 146, C.I. Pigment Red 185, C.I. Pigment Yellow 93, C.I. Pigment Yellow 128, C.I. Pigment Yellow 180, C.I. Pigment Yellow 74, and C.I. Pigment Yellow 185, and wherein the colorant dispersion resin is a resin having sparing solubility defined below:

where the "sparing solubility" means that when 4 parts by mass of the colorant dispersion resin are added to and mixed with 10 parts by mass of the organic solvent, the mixture becomes white turbid at 25° C. or becomes a transparent solution once at 25° C. and then becomes white turbid within 12 hours, wherein the colorant dispersion resin is a polyester resin containing an amide bond structure, and wherein the colorant dispersion resin has a higher density than the binder resin.

* * * * *